US010376945B2

(12) United States Patent
Akashi

(10) Patent No.: US 10,376,945 B2
(45) Date of Patent: Aug. 13, 2019

(54) WORKPIECE TRANSPORT DEVICE

(71) Applicant: KOMATSU INDUSTRIES CORPORATION, Kanazawa-shi, Ishikawa (JP)

(72) Inventor: Hidetoshi Akashi, Kanazawa (JP)

(73) Assignee: KOMATSU INDUSTRIES CORPORATION, Ishikawa (JP)

( * ) Notice: Subject to any disclaimer, the term of this patent is extended or adjusted under 35 U.S.C. 154(b) by 57 days.

(21) Appl. No.: 15/565,765

(22) PCT Filed: Jun. 13, 2016

(86) PCT No.: PCT/JP2016/067583

§ 371 (c)(1),
(2) Date: Oct. 11, 2017

(87) PCT Pub. No.: WO2017/022334

PCT Pub. Date: Feb. 9, 2017

(65) Prior Publication Data

US 2018/0281047 A1 Oct. 4, 2018

(30) Foreign Application Priority Data

Jul. 31, 2015 (JP) ..... 2015-152309

(51) Int. Cl.
*B21D 43/05* (2006.01)

(52) U.S. Cl.
CPC ..... *B21D 43/055* (2013.01)

(58) Field of Classification Search
CPC ..... B21D 43/055
See application file for complete search history.

(56) References Cited

U.S. PATENT DOCUMENTS 5,727,416 A 3/1998 Allgoewer
6,073,551 A 6/2000 Dangelmayr et al.
(Continued)

FOREIGN PATENT DOCUMENTS

CN 1128965 A 8/1996
CN 203265445 U 11/2013
(Continued)

OTHER PUBLICATIONS

The International Search Report for the corresponding international application No. PCT/JP2016/067583, dated Sep. 6, 2016.
(Continued)

*Primary Examiner* — Ronald P Jarrett
(74) *Attorney, Agent, or Firm* — Global IP Counselors, LLP

(57) ABSTRACT

A workpiece transport device is used in a press machine. The workpiece transport device includes a pair of supports and drive mechanisms. The pair of supports support a holder useable to hold a workpiece, so as to allow movement in a transport direction of a workpiece. The drive mechanisms are provided to the pair of supports. The drive mechanisms are configured to move the supports in an up and down direction and a width direction. Each drive mechanism includes a first drive component and a second drive component with each including an electric motor as a drive source, a first link mechanism connecting the first drive component and the support, and a second link mechanism connecting the second drive component and the support.

8 Claims, 17 Drawing Sheets

(56) References Cited

U.S. PATENT DOCUMENTS

| | | | | |
|---|---|---|---|---|
| 6,338,264 | B1 | 1/2002 | Harsch et al. | |
| 9,199,297 | B2 * | 12/2015 | Muller | B21D 43/055 |

FOREIGN PATENT DOCUMENTS

| | | | |
|---|---|---|---|
| CN | 203437536 | U | 2/2014 |
| JP | 2007-44708 | A | 2/2007 |
| JP | 2009-101417 | A | 5/2009 |
| WO | 2008/058496 | A1 | 5/2008 |
| WO | 2014194436 | A1 | 12/2014 |

OTHER PUBLICATIONS

The Office Action for the corresponding Chinese application No. 201680024742.5, dated Sep. 19, 2018.

* cited by examiner

WORKPIECE TRANSPORT DEVICE

CROSS-REFERENCE TO RELATED APPLICATIONS

This application is a U.S. National stage application of International Application No. PCT/JP2016/067583, filed on Jun. 13, 2016. This U.S. National stage application claims priority under 35 U.S.C. § 119(a) to Japanese Patent Application No. 2015-152309, filed in Japan on Jul. 31, 2015, the entire contents of which are hereby incorporated herein by reference.

BACKGROUND

Field of the Invention

The present invention relates to a workpiece transport device used in a press machine.

Description of the Related Art

Conventionally, a workpiece transport device for transporting a workpiece between a plurality of dies has been used in a transfer press in which dies can be mounted (see U.S. Pat. No. 6,073,551 Specification, for example).

The workpiece transport device disclosed in U.S. Pat. No. 6,073,551 includes a pair of bars running in the workpiece transport direction, a workpiece holder detachably supported by the bars, a mechanism for moving the pair of bars in the feed direction, and a mechanism for moving the pair of bars in the lifting and clamping directions. These mechanisms move the workpiece clamped by the workpiece holder in the feed direction, and transport the workpiece between dies.

SUMMARY

With the above-mentioned conventional workpiece transport device, however, a ball screw mechanism is used as the mechanism for moving in the lifting and clamping directions. Therefore, when the workpiece transport device is operated at high speed, abrasion of the threads and so forth can shorten the replacement period of the ball screw, nut, etc.

It is an object of the present invention to provide a workpiece transport device that takes into account the problems encountered with conventional workpiece transport devices, and allows the replacement period of parts to be extended.

The workpiece transport device pertaining to a first aspect is a workpiece transport device used in a press machine, comprising a pair of supports and drive mechanisms. The pair of supports are used to support a holder that holds a workpiece so as to allow movement in a transport direction of the workpiece. The drive mechanisms are provided to the respective supports, and the drive mechanism is configured to move the support in a up and down direction and a width direction. Each drive mechanism has a first drive component and a second drive component, a first link mechanism, and a second link mechanism. The first drive component and the second drive component each have an electric motor as a drive source for moving the support in the up and down direction and the width direction. The first link mechanism connects the first drive component and the support. The second link mechanism connects the second drive component and the support.

Since link mechanisms are thus used to move the supports in the clamping direction and the lifting direction, the replacement period of the parts can be made longer than with a mechanism in which a ball screw is used.

The workpiece transport device pertaining to a second aspect is the workpiece transport device of the first aspect, wherein the first link mechanism is directly connected to the support, and the second link mechanism is directly connected to the support.

This allows the drive by the first drive component to be directly transmitted to the support via the first link member. Also, the drive by the second drive component can be directly transmitted to the support via the second link member.

The workpiece transport device according to a third aspect is the workpiece transport device according to the second aspect, wherein the first link mechanism has a first link member and a first lever member. The first link member is rotatably linked to the support. The first lever member is connected to the first drive component and is configured to be rotated by the first drive component. The first link member and the first lever member are rotatably linked to each other. The second link mechanism has a second link member and a second lever member. The second link member is rotatably linked to the support. The second lever member is connected to the second drive component and is configured to be rotated by the second drive component. The second link member and the second lever member are rotatably linked to each other.

This allows the rotation of the electric motor to be transmitted to the support by the lever members and the link members.

The workpiece transport device according to a fourth aspect is the workpiece transport device according to any of the first to third aspects, wherein the drive mechanism further has a base. The first drive component and the second drive component are fixed to this base.

Fixing the first drive component and the second drive component to the base in this way keeps the electric motor wiring and so forth from moving during the transport of the workpiece, and therefore prevents deterioration of the wiring, etc.

The workpiece transport device pertaining to a fifth aspect is the workpiece transport device according to the third aspect, wherein the drive mechanism further has a base and a third link mechanism. The first drive component and the second drive component are fixed to the base. The third link mechanism forms a parallel link with the first link mechanism and connects the support to the base.

Forming a parallel link allows the support to be moved in the up and down direction and the width direction in a state in which the support is stably held horizontally.

The workpiece transport device according to a sixth aspect is the workpiece transport device according to the fifth aspect, wherein the third link mechanism has a third link member, a fourth link member, and a linking member. The third link member is disposed parallel to the first lever member and is rotatably linked to the base. The fourth link member is disposed parallel to the first link member and is rotatably linked to the support. The linking member is rotatably linked to the third link member and the fourth link member. The linking member is rotatably linked to the first link member and the first lever member at the linked parts of the first link member and the first lever member.

This allows a parallel link to be formed by the third link mechanism and the first link mechanism.

The workpiece transport device according to a seventh aspect is the workpiece transport device according to the first aspect, wherein the first link mechanism is disposed more to an outside than an inner end of the first drive component, or at the same position as this inner end. The second link mechanism is disposed more to an outside than an inner end of the second drive component, or at the same position as this inner end.

The first link mechanism and the second link mechanism are thus configured not to protrude inward beyond the first drive component and the second drive component. Accordingly, the links can be kept from protruding into the transport space of the workpiece, and plenty of space can be ensured between the pair of supports. Also, hand-over is easier when the workpiece is brought in from the loading device to the press device, and when the workpiece is taken out from the press device to the unloading device.

The workpiece transport device according to an eighth aspect is the workpiece transport device according to the fourth aspect, further comprising an adjustment mechanism. The adjustment mechanism is configured to adjust the spacing of the pair of supports by moving the base in the width direction. When the workpiece is transported, the support moves in the up and down direction and the width direction in a state in which the base is fixed in a position adjusted by the adjustment mechanism.

Thus, the adjustment mechanism for adjusting the spacing in the width direction of the pair of supports and the drive mechanisms for moving the support in the up and down direction and the width direction when transporting the workpiece in a press operation are provided separately. That is, adjustment and movement are performed by different mechanisms. With a conventional workpiece transport device, the adjustment and movement are performed by a single mechanism, but dividing them into two mechanisms as in the present invention shortens the distance that each mechanism has to move the support. Accordingly, it is possible to reduce the parts in each mechanism, and drive will require less energy. Also, since parts can be made smaller, weight can be reduced and a higher speed can be achieved.

Effects of the Invention

The present invention makes it possible to provide a workpiece transport device with which the replacement period of parts can be extended.

DETAILED DESCRIPTION OF THE EMBODIMENT(S)

A transfer feeder pertaining to an embodiment of the workpiece transport device of the present invention will now be described through reference to the drawings.

1. Configuration 1-1. Overview of Transfer Press

Figure 1:
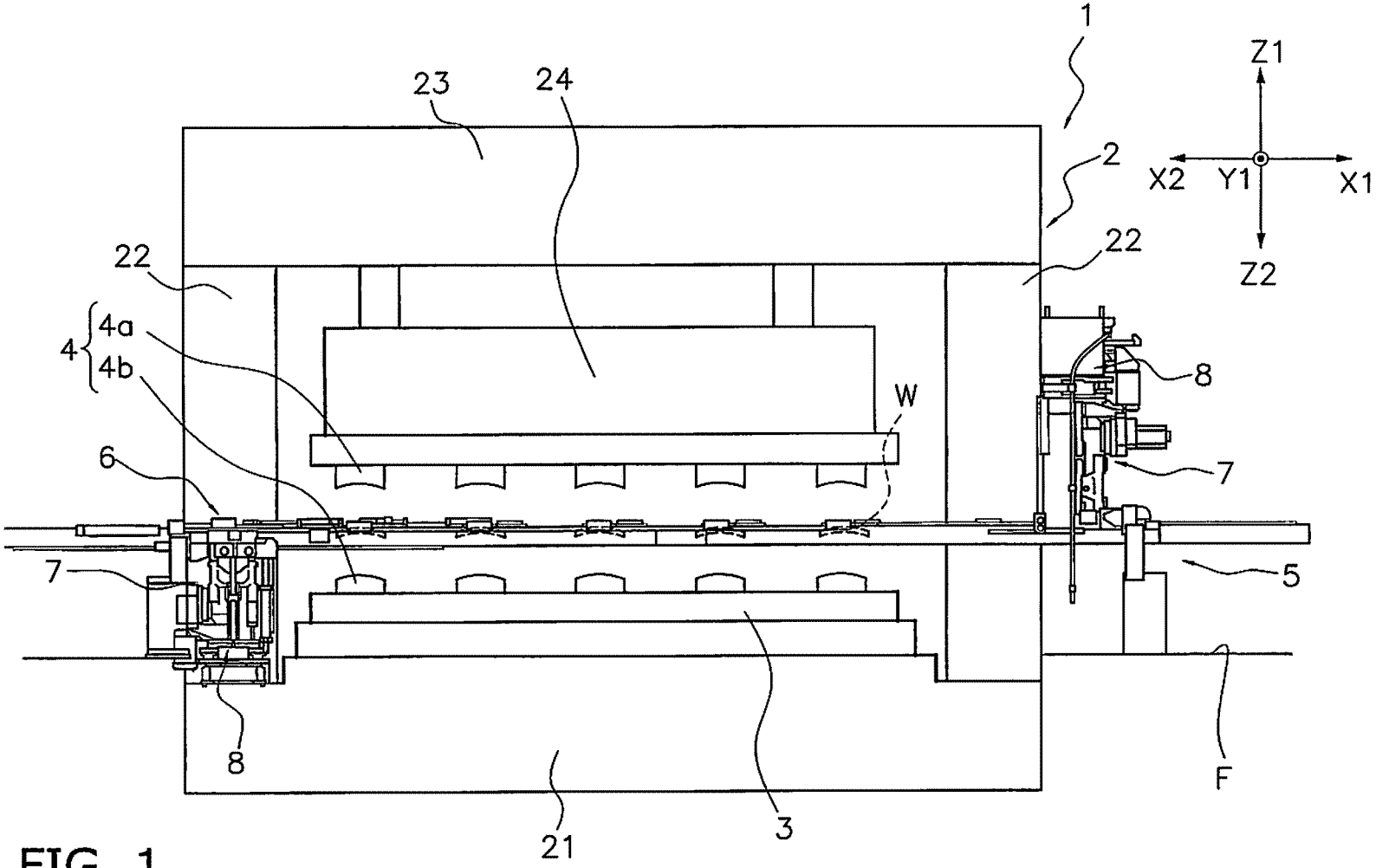
FIG. 1 is a simplified front view showing an overview of a transfer press pertaining to the present invention.

FIG. 1 is a simplified diagram showing an overview of a transfer press 1 in an embodiment pertaining to the present invention.

As shown in FIG. 1, the transfer press 1 in this embodiment comprises a press device main body 2, a moving bolster 3, a die 4 composed of an upper die 4*a* and a lower die 4*b*, and a transfer feeder 5. The upper die 4*a* of the die 4 is attached to the press device main body 2, the lower die 4*b* is placed on the moving bolster 3, and a pressing operation is performed on the workpiece W transported by the transfer feeder 5.

In FIG. 1, the downstream direction in the feed direction and the workpiece transport direction is indicated by X1, and the upstream direction is indicated by X2. In this Specification, the description does not distinguish between the upstream direction and the downstream direction, it will simply be referred to as the feed direction X or the workpiece transport direction X. Also, the upper side in the lifting direction is denoted by Z1 and the lower side is denoted by Z2, and when the description does not distinguish between the upper side and the lower side in this Specification, it is simply referred to as the lifting direction Z. Furthermore, in the clamping direction, the right direction facing downstream is denoted by Y1 and the left direction is denoted by Y2, and when the description does not distinguish between the right direction and the left direction in this Specification, it is simply referred to as the clamping direction Y.

1-2. Press Device Main Body

The press device main body 2 mainly has a bed 21, uprights 22, a crown 23, and a slide 24. As shown in FIG. 1, the bed 21 is embedded in a floor F and serves as the base of the press device main body 2.

Figure 2:
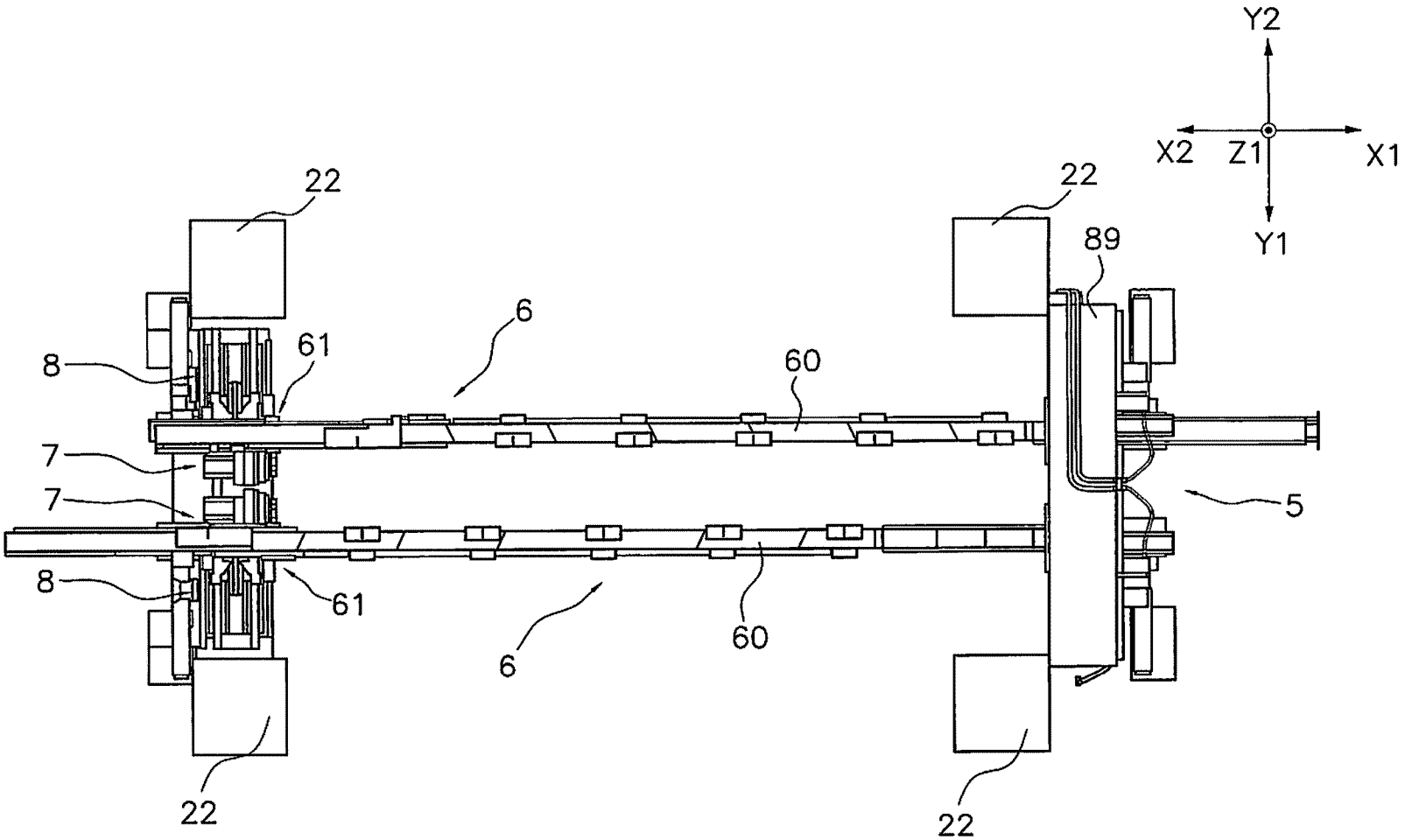
FIG. 2 is a partial plan view showing the transfer press in FIG. 1.

FIG. 2 is an oblique view of the transfer press 1 as viewed from above, but the crown 23, the slide 24, the moving bolster 3 and the bed 21 are omitted for the sake of illustration. The uprights 22 are columnar members, and as shown in FIG. 2, two are provided on the upstream direction X2 side in the feed direction X and two on the downstream direction X1 side. The two uprights 22 disposed on the upstream direction X2 side are disposed with a specific spacing and are disposed on the right direction Y1 side and the left direction Y2 side in the clamping direction Y. The two uprights 22 disposed on the downstream direction X1 side are disposed with a specific spacing and are disposed on the right direction Y1 side and the left direction Y2 side in the clamping direction Y. That is, the four uprights 22 are disposed so as to form a rectangular shape in plan view. In FIG. 1, the two uprights 22 on the right direction Y1 side are not shown.

The crown 23 is supported on top of the four uprights 22 as shown in FIG. 1. The crown 23 is provided with a slide mechanism for raising and lowering the slide 24 that hangs down from the crown 23. The slide 24 can be raised and lowered by the slide mechanism provided to the crown 23. The upper die 4*a* is removably attached to the lower face of the slide 24 by a die clamper (not shown).

1-3. Moving Bolster

The lower die 4*b* is placed on the upper surface of the moving bolster 3. The moving bolster 3 is configured to be able to move over the upper face of the bed 21 when the die 4 is replaced. Rails (not shown) are laid on the floor F and the bed 21. The moving bolster 3 is provided with a drive mechanism for driving the moving bolster 3.

When replacing the die 4, the moving bolster 3 passes between the uprights 22 in the clamping direction (toward or away from the viewer in FIG. 1), and moves to the outside of the press device main body 2. After the die 4 has been replaced with the next one, the moving bolster 3 passes between the uprights 22 and moves to the inside of the press device main body 2.

1-4. Transfer Feeder

Figure 3:
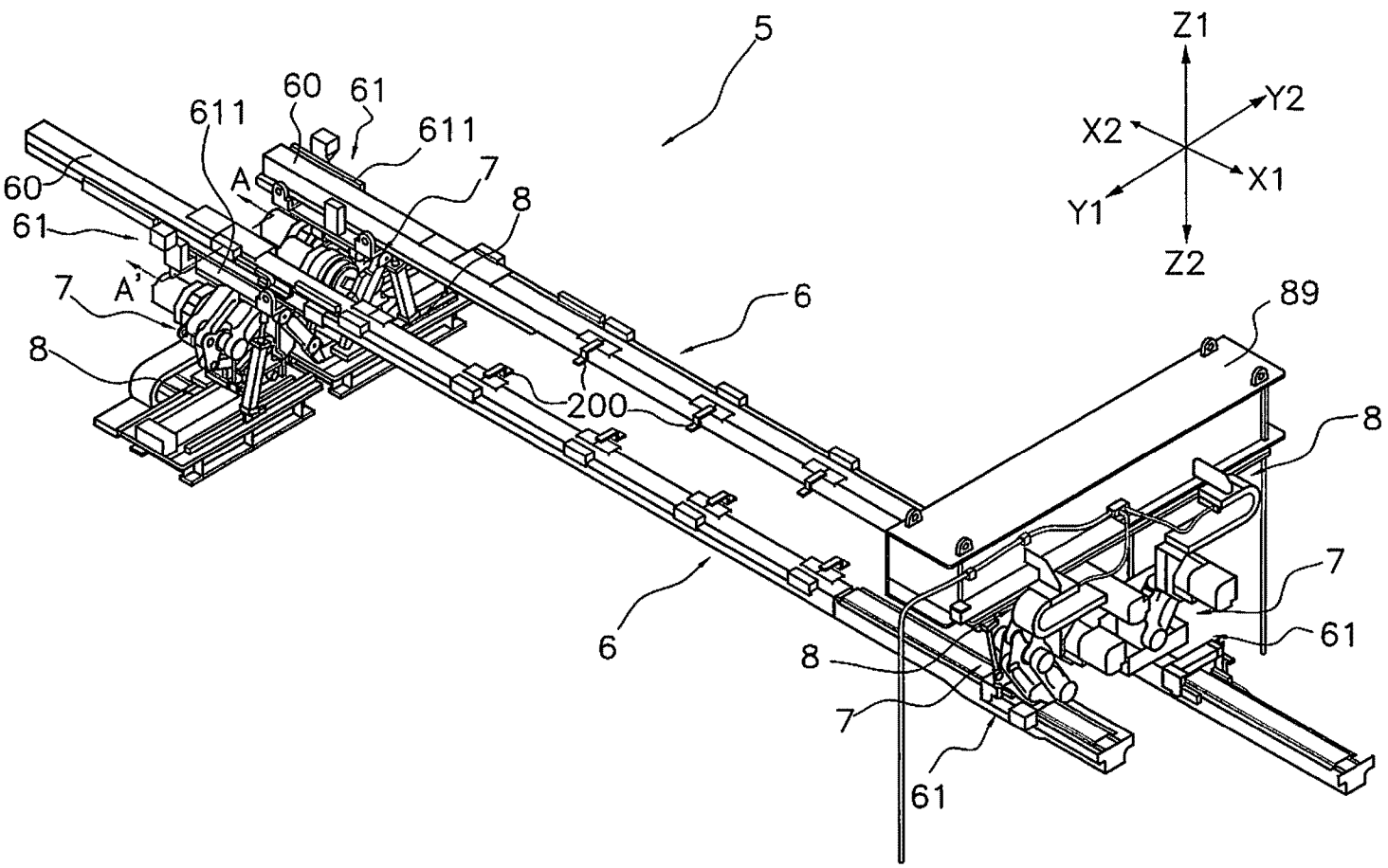
FIG. 3 is an oblique view showing the transfer feeder in FIG. 1.
Figure 4:
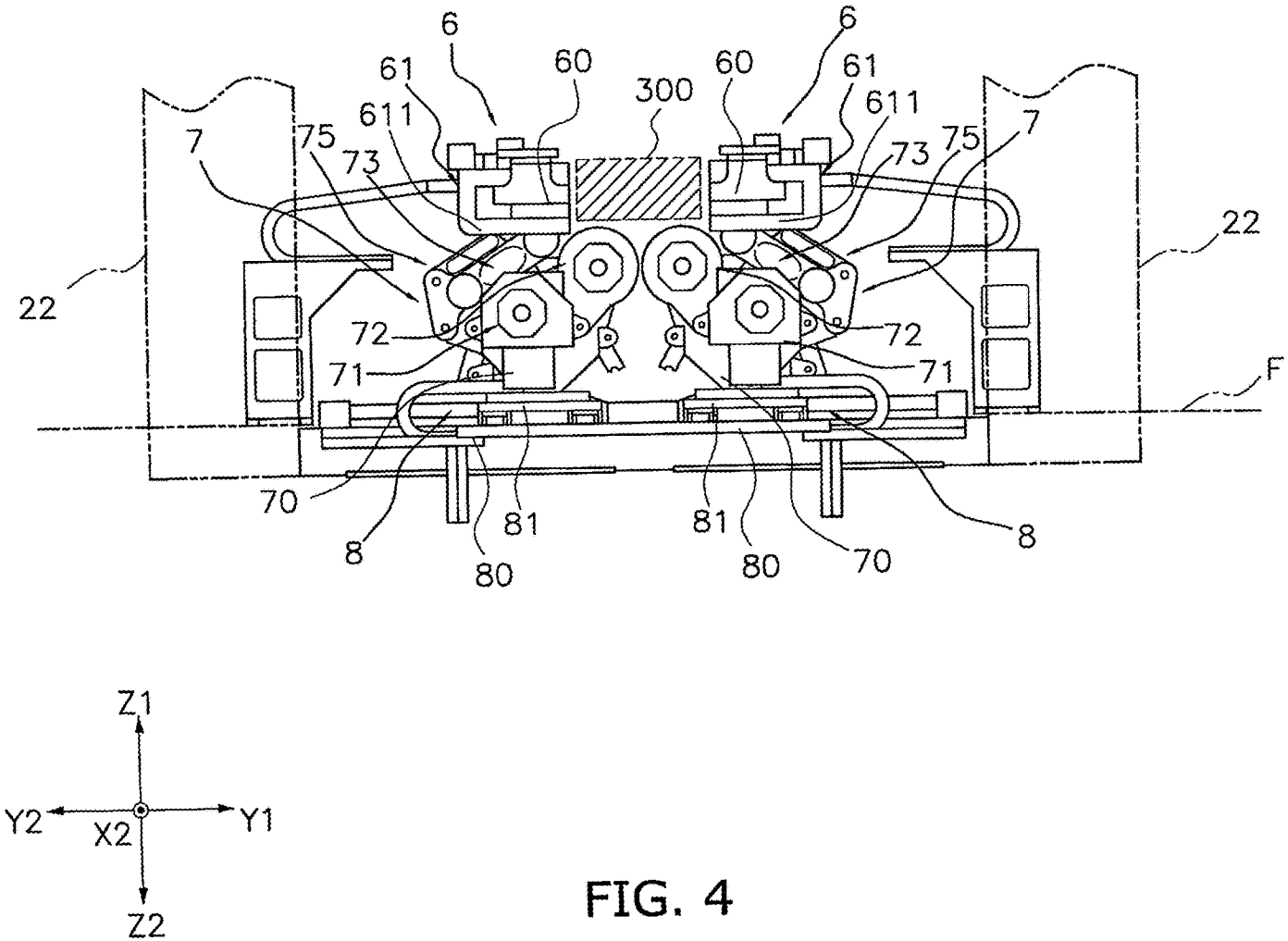
FIG. 4 is a side view as seen from the upstream side of the transfer feeder in FIG. 3.
Figure 5:
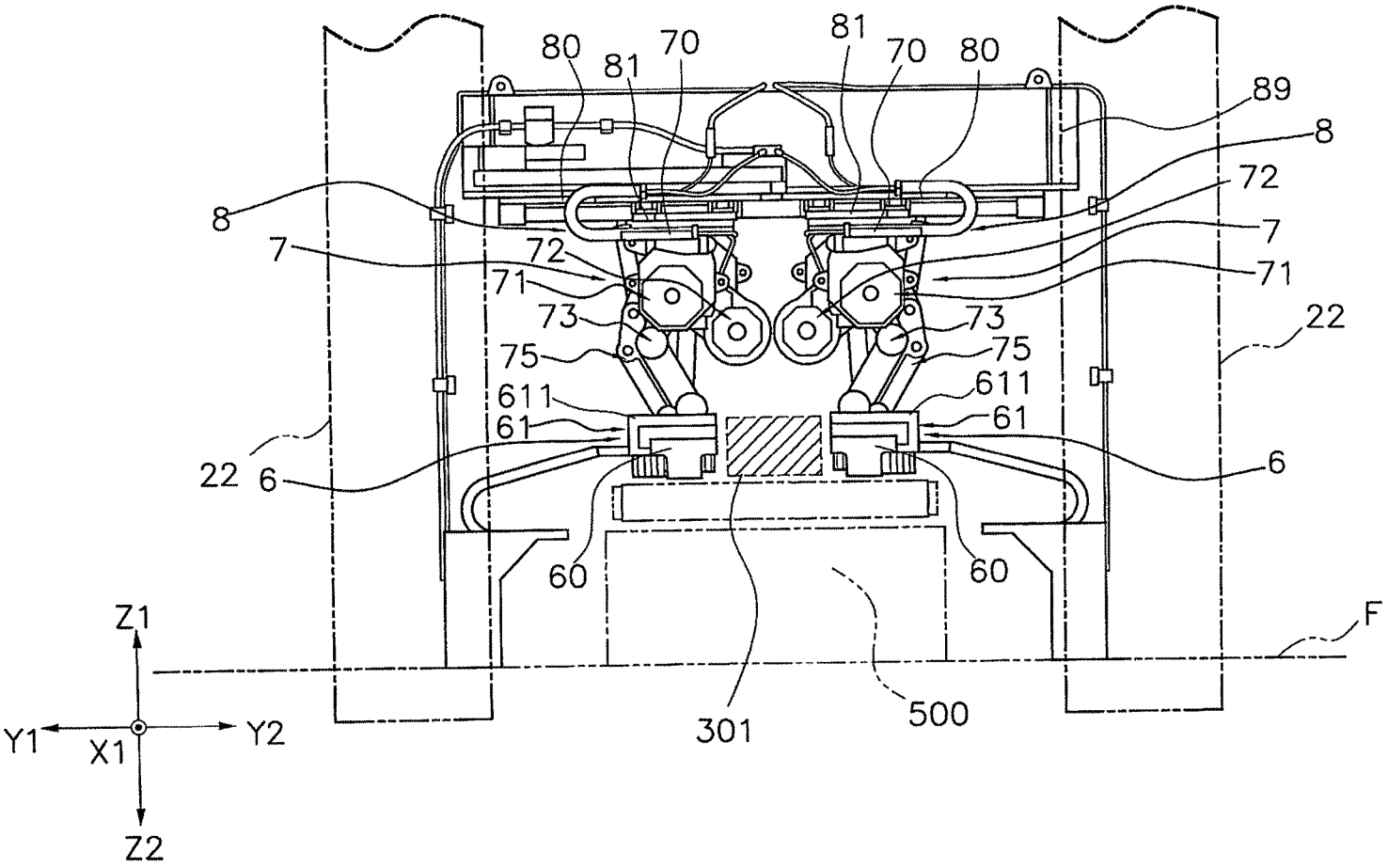
FIG. 5 is a side view as seen from the downstream side of the transfer feeder in FIG. 3.

FIG. 3 is an oblique view of the transfer feeder 5. FIG. 4 is a diagram of the transfer feeder 5 as viewed from the upstream direction X2 side in the feed direction X. FIG. 5 is a diagram of the transfer feeder 5 as viewed from the downstream direction X1 side in the feed direction X. In FIGS. 4 and 5, the uprights 22, the moving bolster 3, etc., are indicated by two-dot chain lines.

As shown in FIGS. 2 to 5, the transfer feeder 5 in this embodiment mainly comprises supports 6, lifting and clamping drive mechanisms 7, and adjustment mechanisms 8.

A pair of the supports 6 is provided, and these are disposed parallel to each other along the feed direction X.

The supports 6 support fingers 200 that grip the workpiece W so as to allow movement in the feed direction X. The lifting and clamping drive mechanisms 7 move the supports 6 in the lifting direction Z and the clamping direction Y. The lifting and clamping drive mechanisms 7 are provided at both ends of each support 6, so a total of four lifting and clamping drive mechanisms 7 are provided. The adjustment mechanisms 8 are provided to each of the lifting and clamping drive mechanisms 7, and adjust the position of the lifting and clamping drive mechanisms 7 in the clamp direction Y.

1-4-1. Supports

As shown in FIGS. 3 to 5, each support 6 has a bar 60 and a feed drive mechanism 61 for driving the bar 60 in the feed direction.

Bars and Feed Drive Mechanisms

The bars 60 have an elongated quadrangular prism shape, and are disposed parallel to each other along the feed direction X. A plurality of the fingers 200 are detachably attached to the upper faces of the bars 60 along the feed direction X.

Figure 6:
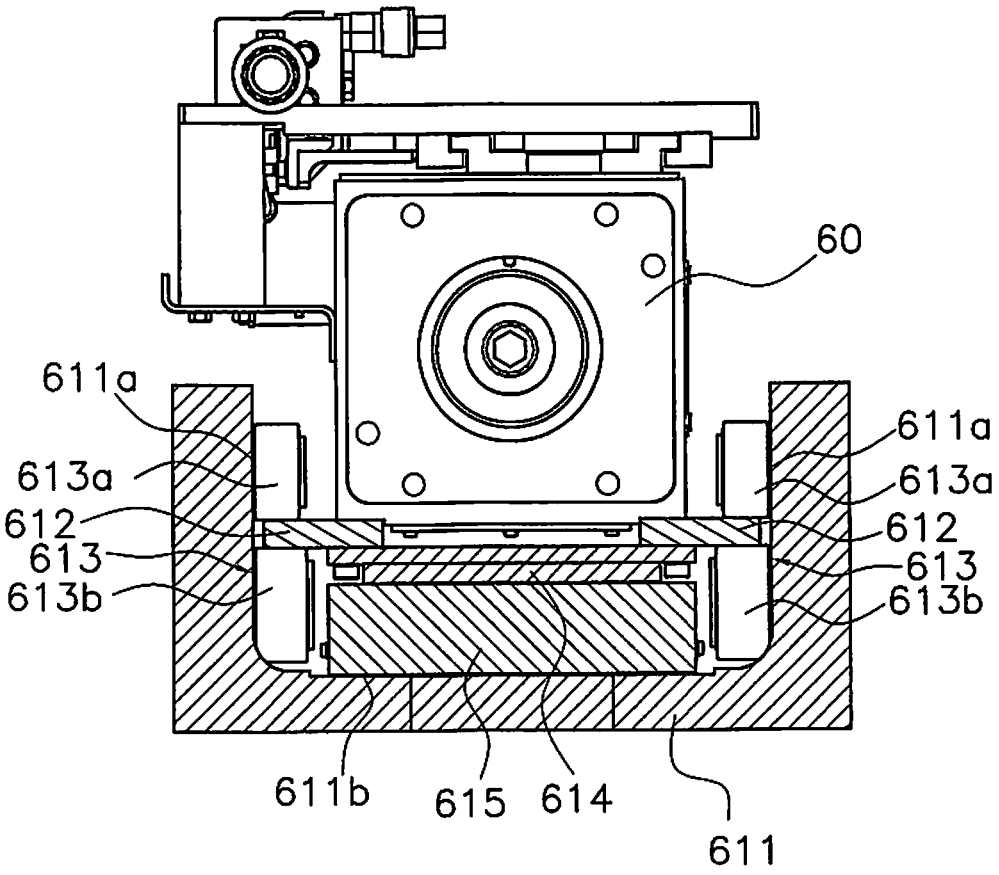
FIG. 6 is a partial cross section along the A-A' line in FIG. 3.

Two feed drive mechanisms 61 are provided for each bar 60. A feed drive mechanism 61 is provided at the end of the bar 60 on the upstream direction X2 side in the feed direction X and at the end on the downstream direction X1 side. FIG. 6 is a cross section of a feed drive mechanism 61 along the A-A' line in FIG. 3. The four feed drive mechanisms 61 all have the same configuration, and will be described below by using the feed drive mechanism 61 shown in FIG. 6 on the upstream direction X2 side (the right direction Y1 side) as an example.

The feed drive mechanisms 61 provide linear motor drive, and mainly each have a support frame 611 for supporting the bars 60, rails 612, rollers 613, a magnet 614, and a coil 615.

As shown in FIG. 6, the support frame body 611 has a U shape in cross section, and is disposed so as to cover the bars 60 from the lower side. The support frame 611 is supported from below by a lifting and clamping drive mechanism 7 (discussed below).

The rails 612 are provided on the lower face of the bar 60 and protrude from both side faces of the bar 60. The rollers 613 have an upper roller 613*a* and a lower roller 613*b* that are rotatably provided on each of the opposing inner faces 611*a* of the support frame 611. The ends of the rails 612 are fitted between the upper rollers 613*a* and the lower rollers 613*b* disposed above and below. A plurality of sets of the upper roller 613*a* and the lower roller 613*b* are provided along the feed direction X.

The magnet 614 is disposed under the rails 612. The coil 615 is disposed on the inner bottom face 611*b* of the U-shaped support frame 611 so as to be opposite the magnet 614.

When a current is passed through the coil 615, an attractive or repulsive force is generated between the coil 615 and the magnet 614, and the bar 60 is guided by the upper rollers 613*a* and the lower rollers 613*b* so that the bar 60 moves in the feed direction X with respect to the support frame 611.

The feed drive mechanism 61 on the downstream direction X1 side is vertically inverted as compared to the feed drive mechanism 61 on the upstream direction X2 side.

1-4-2. Lifting and Clamping Drive Mechanism

As shown in FIGS. 3 to 5, the transfer feeder 5 in this embodiment is provided with four lifting and clamping drive mechanisms 7. The two lifting and clamping drive mechanisms 7 on the upstream direction X2 side shown in FIG. 4 are disposed in left and right symmetry. The two lifting and clamping drive mechanisms 7 on the downstream direction X1 side shown in FIG. 5 are disposed in up and down symmetry with the two lifting and clamping drive mechanisms 7 on the upstream direction X2 side shown in FIG. 4.

Figure 7:
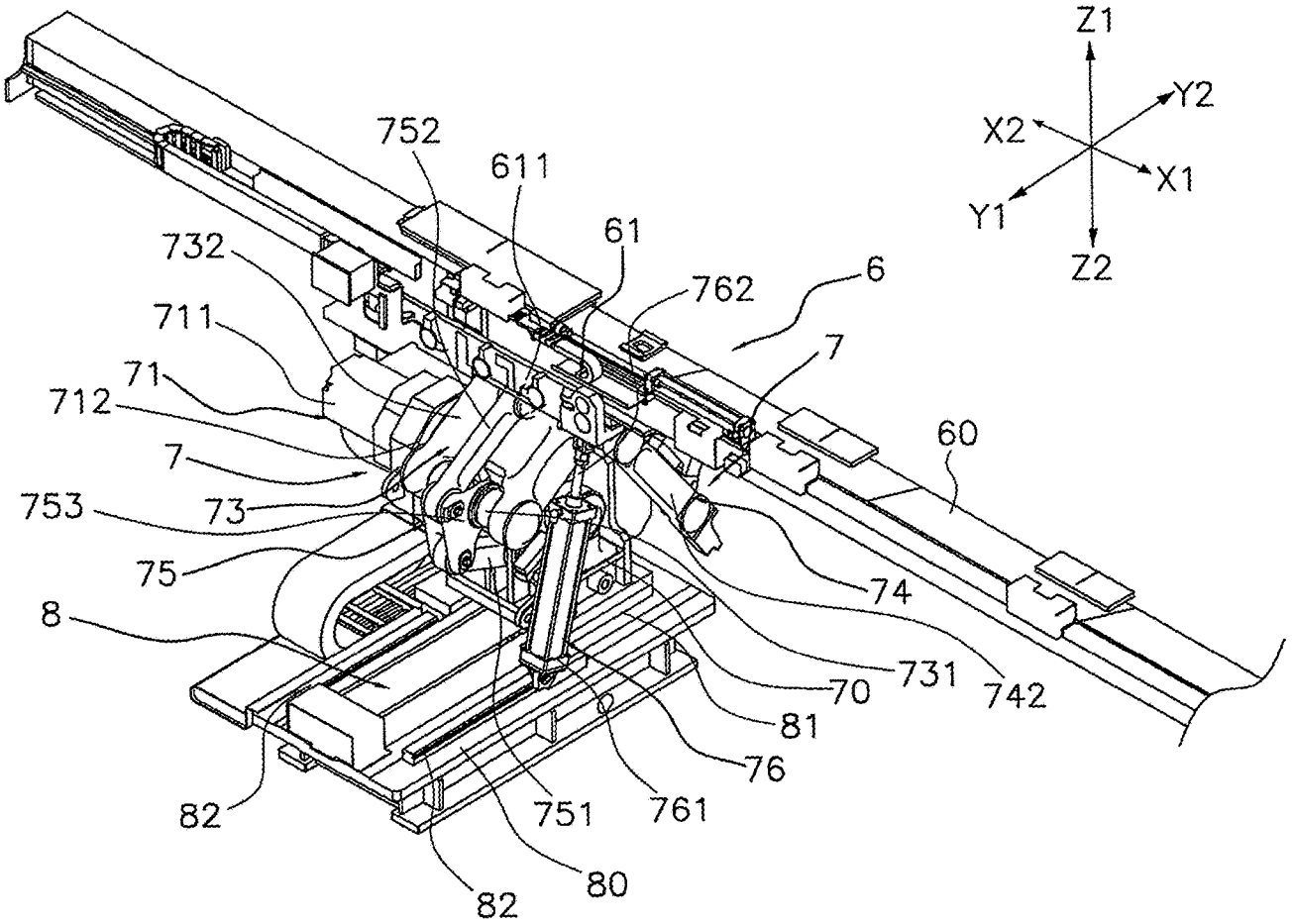
FIG. 7 is a detail view of the transfer feeder in FIG. 1.
Figure 8:
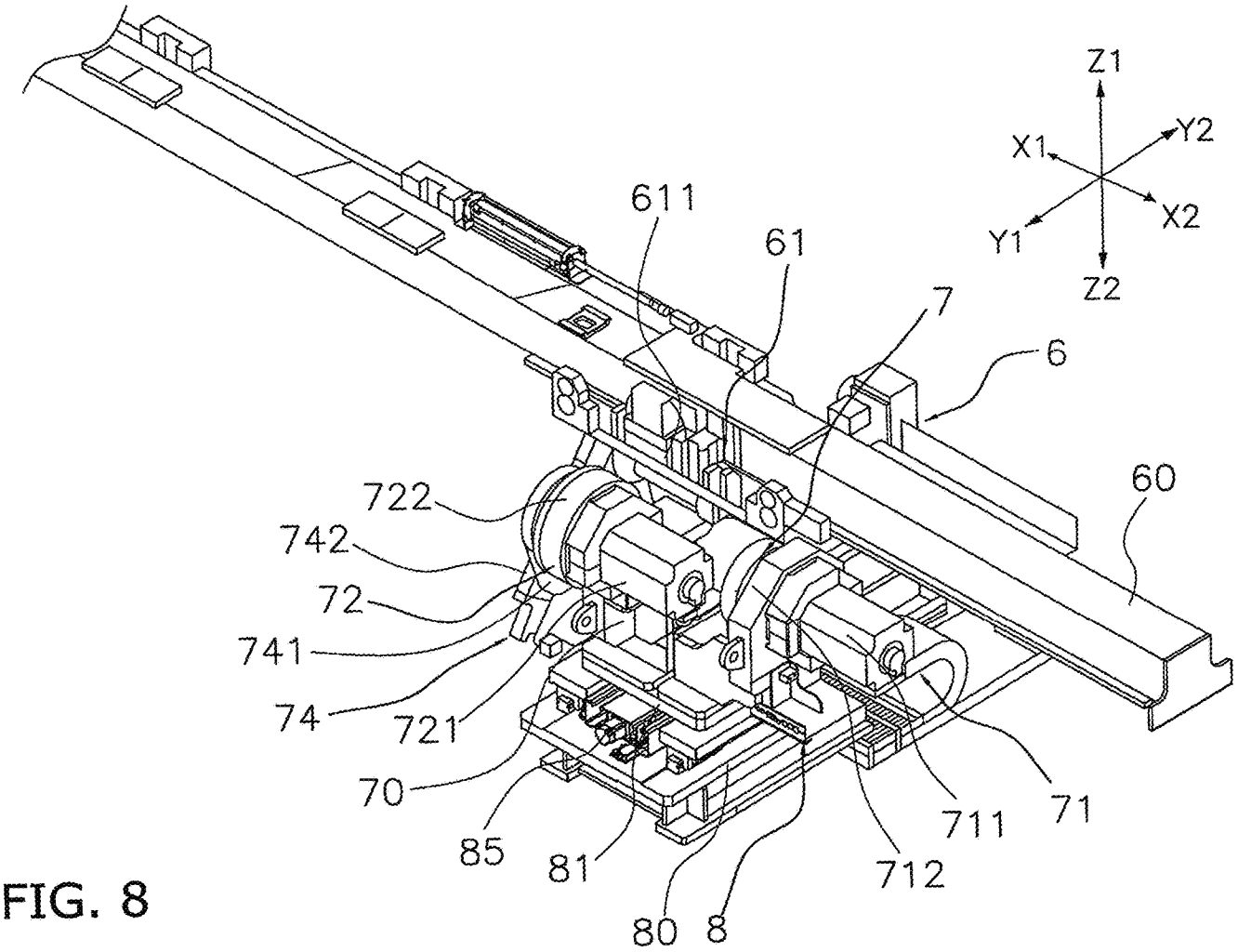
FIG. 8 is a detail view of the transfer feeder in FIG. 1.
Figure 9:
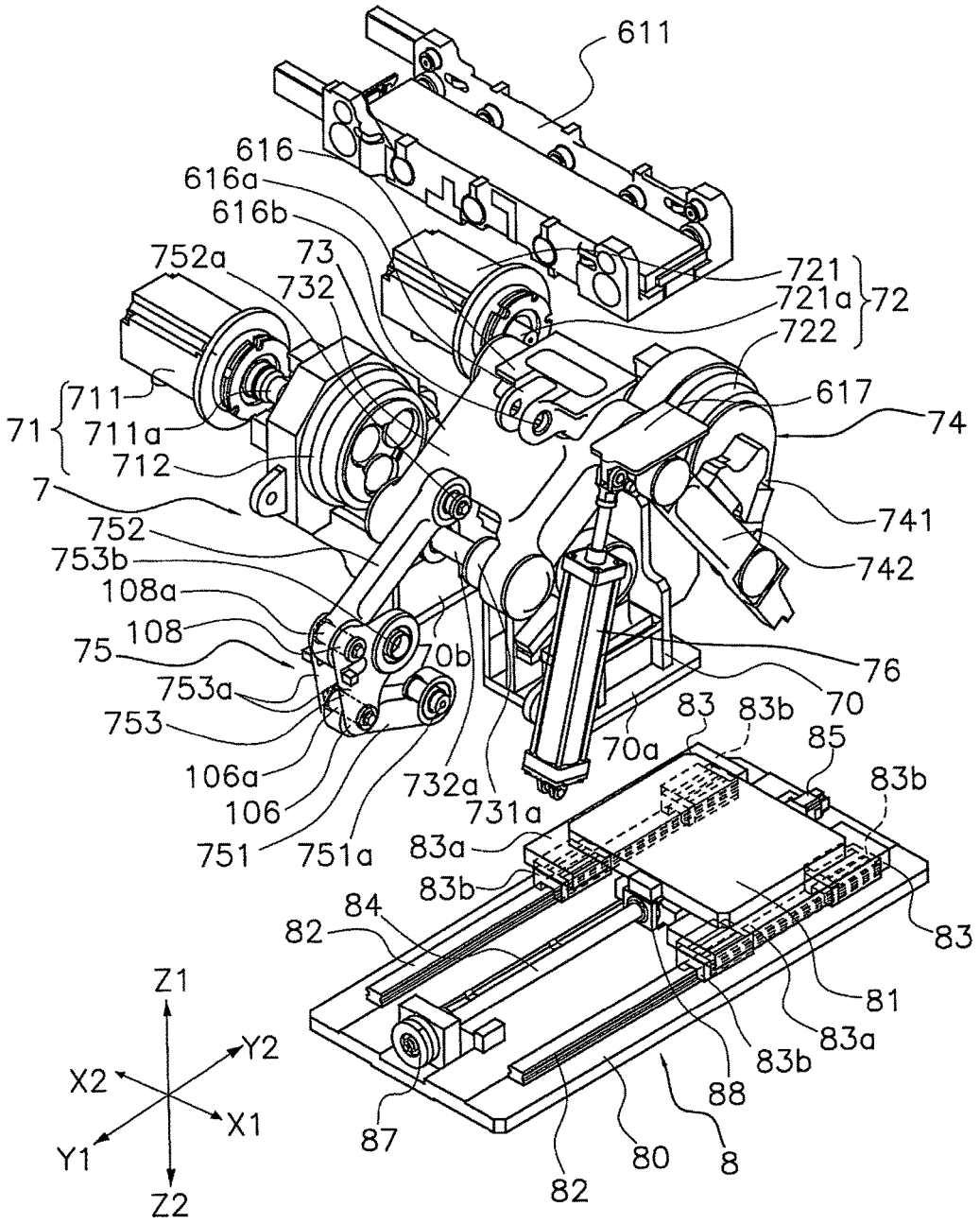
FIG. 9 is an exploded oblique view showing the lifting and clamping drive mechanism in FIG. 3.
Figure 10:
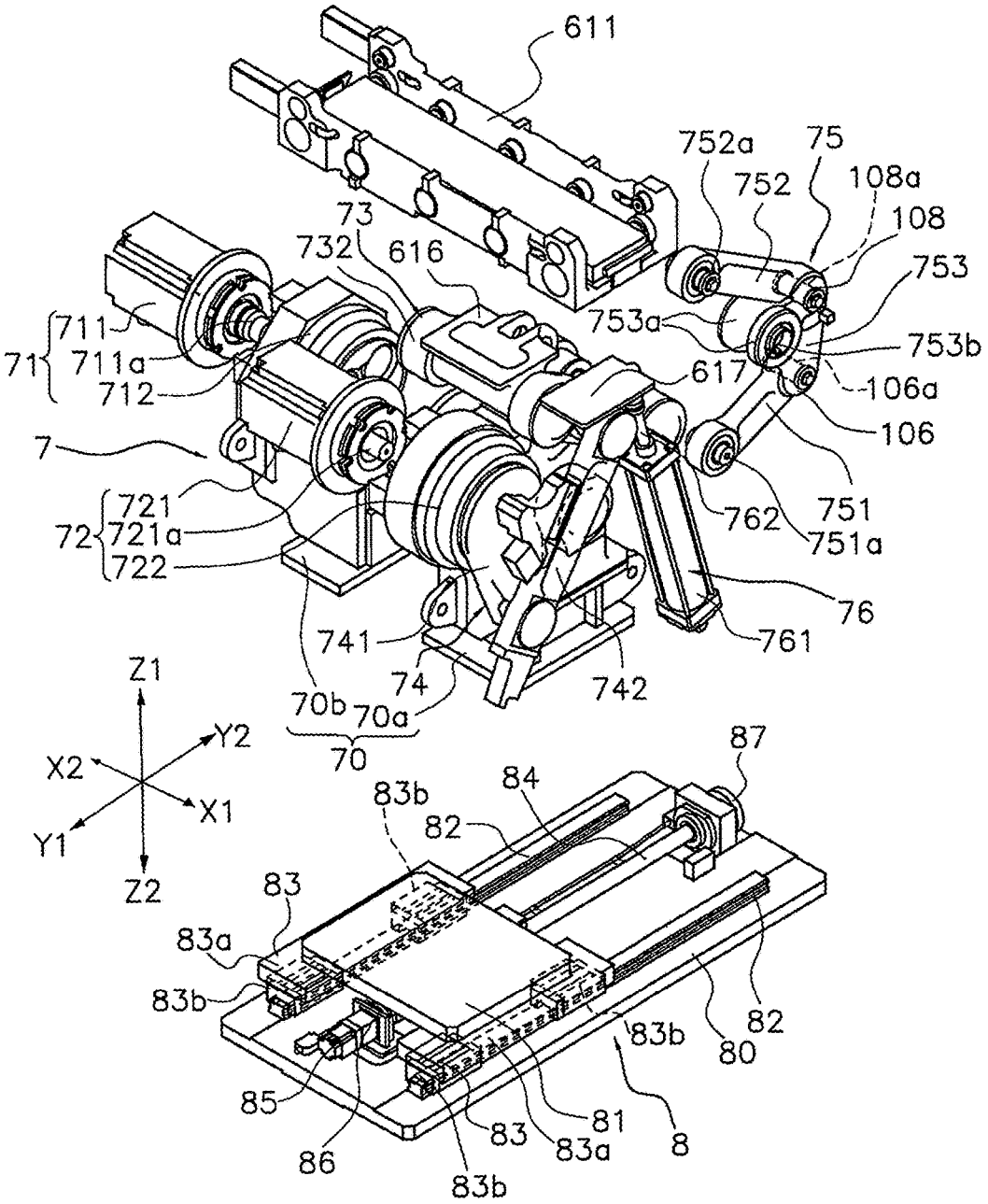
FIG. 10 is an exploded oblique view showing the lifting and clamping drive mechanism in FIG. 3.
Figure 11:
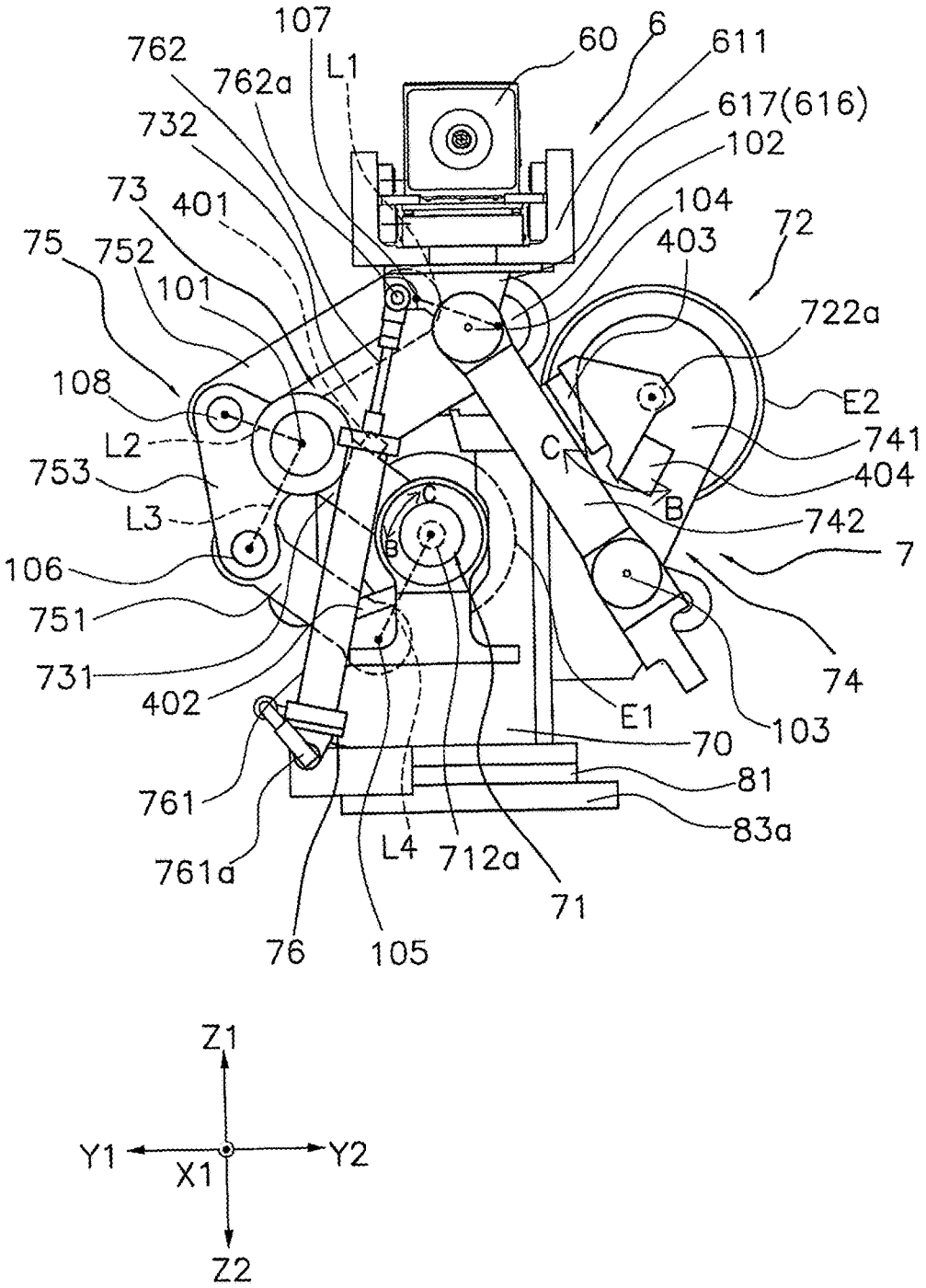
FIG. 11 is a view of the lifting and clamping drive mechanism in FIG. 3, as viewed to from the downstream side, in a state in which the supports are disposed in a clamped down position.

FIG. 7 is an oblique view of the lifting and clamping drive mechanism 7 on the upstream direction X2 side in the feed direction X and on the right direction Y1 side, as seen from above in the downstream direction X1. FIG. 8 is an oblique view of the lifting and clamping drive mechanism 7 shown in FIG. 7 as seen from above in the upstream direction X2. FIG. 9 is a partially exploded oblique view of the support frame 611, the lifting and clamping drive mechanism 7, and the adjustment mechanism 8 on the upstream direction X2 side and on the right direction Y1 side. FIG. 10 is a partially exploded oblique view of the support frame 611, the lifting and clamping drive mechanism 7, and the adjustment mechanism 8 on the upstream direction X2 side and on the left direction Y2 side. FIG. 11 is a front view of the lifting and clamping drive mechanism 7 shown in FIG. 7, as seen from the downstream direction X1 side.

As shown in FIGS. 7, 8, and 11, the lifting and clamping drive mechanism 7 mainly has a base 70, a first drive component 71, a second drive component 72, a first link mechanism 73, a second link mechanism 74, a third link mechanism 75, and a cylinder 76.

The base 70 is fixed on a carrier 81 of an adjustment mechanism 8 (discussed below). As shown in the exploded view in FIG. 10, the base 70 is divided into two members, a first member 70*a* and a second member 70*b*. The first member 70*a* is disposed on the downstream direction X1 side of the second member 70*b*. The first member 70*a* and the second member 70*b* are assembled to constitute the base 70.

1-4-2-1. First Drive Component

As shown in FIG. 11, the first drive component 71 is fixed in the approximate center in the clamping direction Y of the base 70. As shown in FIGS. 7 to 10, the first drive component 71 has a first electric motor 711 and a first reduction gear 712. As shown in FIG. 9, the first electric motor 711 is disposed such that its rotation shaft 711*a* extends along the feed direction X, and is attached to the first reduction gear 712. As shown in FIGS. 7 to 9, the first electric motor 711 is disposed on the upstream side X2 side of the first reduction gear 712.

The first reduction gear 712 is substantially cylindrical in shape, and has an output shaft 712*a* (see FIG. 11) that is coaxial with the rotation shaft 711*a*. The first reduction gear 712 is fixed to the base 70 as shown in FIGS. 7 to 11. More precisely, the first reduction gear 712 is fixed to the second member 70*b* of the base 70 as shown in FIGS. 9 and 10. A servomotor is used for the first electric motor 711, for example.

1-4-2-2. Second Drive Component

As shown in FIGS. 8, 10, and 11, the second drive component 72 is fixed to the base 70 on the left side Y2 side (also referred to as the inner side in the clamping direction Y). The second drive component 72 has a second electric motor 721 and a second reduction gear 722. As shown in FIGS. 9 and 10, the second electric motor 721 is disposed such that its rotation shaft 721*a* runs along the feed direction X, and is attached to the second reduction gear 722. As shown in FIGS. 7 and 8, the second electric motor 721 is disposed on the upstream side X2 side of the second reduction gear 722.

The second reduction gear 722 is substantially cylindrical in shape, and has an output shaft 722*a* (see FIG. 11) that is coaxial with the rotation shaft 721*a*. The second reduction gear 722 is fixed to the base 70. More precisely, the second reduction gear 722 is fixed to the first member 70*a* of the base 70 as shown in FIGS. 9 and 10. A servomotor is used for the second electric motor 721, for example.

1-4-2-3. First Link Mechanism

As shown in FIG. 11, the first link mechanism 73 connects the first drive component 71 and the support 6. The first link mechanism 73 is disposed farther outside than the end E1 on the inner side of the first drive component 71. In other words, the first link mechanism 73 is disposed so as not to protrude farther inward than the first drive component 71 (the arrow Y2 side in FIG. 11).

The first link mechanism 73 has a first lever member 731 and a first link member 732. The first lever member 731 is rod-shaped, and is fixed at one end to the output shaft 712*a* of the first reduction gear 712. The first lever member 731 rotates around the output shaft 712*a* along with the rotation of the rotation shaft 711*a* of the first electric motor 711.

The first link member 732 connects the distal end of the first lever member 731 and the support 6. As shown in FIG. 9, the first link member 732 is a thick plate-like member whose main face is disposed running in the feed direction X, and the end on the downstream direction X1 side of the first link member 732 is shown in the front view in FIG. 11.

In FIG. 11, a first linked part 101 is provided at one end of the first link member 732, and the first link member 732 is rotatably linked to the distal end of the first lever member 731 at this first linked part 101. More precisely, as shown in FIG. 9, a linking shaft 732*a* is formed at the end of the first link member 732 at the first linked part 101, and the linking shaft 732*a* is inserted into a through-hole (not shown) formed in the distal end 731*a* of the first lever member 731.

As shown in FIG. 11, a second linked part 102 is provided at the other end of the first link member 732, and the first link member 732 is rotatably linked to the support 6 at this second linked part 102. As shown in FIGS. 9 to 11, the support 6 has a first link-coupled part 616 fixed to the support frame 611 on the lower side of the support frame 611. Thus, the first link member 732 is rotatably linked to the first link-coupled part 616 at the second linked part 102. At the second linked part 102, a shaft is formed at the end of the first link member 732 and is axially supported by the first link-coupled part 616.

In FIG. 11, the first link-coupled part 616 cannot be seen because it is located on the rear face side of a second link-coupled part 617 (discussed below), but a number is added in parentheses to indicate its position.

Stoppers 401 and 402 are provided to restrict the movement of the first lever member 731 when an abnormality occurs and the first lever member 731 would otherwise operate beyond its normal motion. The stoppers 401 and 402 are molded from urethane or the like. As shown in FIG. 11, the stopper 401 is disposed on the upper side of the first lever member 731, and when the first lever member 731 further rotates in the direction of the arrow C from the state in FIG. 14 (discussed below), the stopper 401 hits the base 70 and restricts the movement of the first lever member 731.

Also, the stopper 402 is provided to the base 70 below the first lever member 731, and when the first lever member 731 further rotates in the direction of the arrow B from the state shown in FIG. 13 (discussed below), the stopper 402 hits the first lever member 731 and restricts the movement of the first lever member 731.

1-4-2-4. Second Link Mechanism

As shown in FIG. 11, the second link mechanism 74 connects the second drive component 72 and the support 6. The second link mechanism 74 is disposed farther to the outside than the end E2 on the inner side of the second drive component 72. In other words, the second link mechanism 74 is disposed so as not to protrude farther inward than the second drive component 72 (the arrow Y2 side in FIG. 11).

The second link mechanism 74 has a second lever member 741 and a second link member 742. The second lever member 741 is a rod-shaped member, is fixed at one end to the output shaft 722*a* of the second reduction gear 722, and rotates around the output shaft 722*a* along with the rotation of the rotation shaft 721*a* of the second electric motor 721.

The second link member 742 links the distal end of the second lever member 741 and the support 6. The second link member 742 is a rod-shaped member, has a third linked part 103 provided at one end thereof, and is rotatably linked to the distal end of the second lever member 741 at the third linked part 103.

A fourth linked part 104 is provided to the other end of the second link member 742, and the second link member 742 is rotatably linked to the support 6 at the fourth linked part 104. As shown in FIGS. 9 to 11, the support 6 has the second link-coupled part 617 fixed to the support frame 611 on the lower side of the support frame 611. The second link-coupled part 617 is disposed more on the downstream direction X1 side than the first link-coupled part 616. Thus, the second link member 742 is rotatably linked to the second link-coupled part 617 at the fourth linked part 104.

The detailed configuration of the third linked part 103 is not depicted, but, at the third linked part 103, a pin, and an insertion hole into which the pin is inserted, etc., are formed at the second link member 742 and the second lever member 741, and the second link member 742 and the second lever member 741 should be rotatably linked to each other. At the fourth linked part 104, similarly a pin, an insertion hole into which the pin is inserted, etc., are formed in the second link member 742 and the first link-coupled part 616, and the second link member 742 and the first link coupling part 616 should be rotatably linked to each other.

Also, as shown in FIG. 11, stoppers 403 and 404 are provided to restrict the movement of the second link member 742 when an abnormality occurs and the second link member 742 operates beyond its normal motion. The stopper 403 and 404 are molded from urethane or the like. The stoppers 403 and 404 are provided to the portion of the second lever member 741 that is connected to the second drive component 72. The stopper 403 hits the second link member 742 when the second lever member 741 rotates further in the arrow B direction from the state shown in FIG. 11, and restricts the movement thereof. The stopper 404 hits the second link member 742 when the second lever member 741 rotates further in the arrow C direction from the state shown in FIG. 13, and restricts the movement thereof.

1-4-2-5. Third Link Mechanism

As shown in FIG. 11, the third link mechanism 75 constitutes a parallel link mechanism with the first link mechanism 73, and links the base 70 to the support 6. The third link mechanism 75 includes a third link member 751, a fourth link member 752, and a linking member 753.

Third Link Member

The third link member 751 is a rod-shaped member having two ends, and is disposed parallel to the first lever member 731. A fifth linked part 105 is provided at one end of the third link member 751, and the third link member 751 is rotatably linked to the base 70 (more precisely, the first member 70*a*) in the fifth linked part 105. With the fifth linked part 105, a shaft 751*a* (see FIGS. 9 and 10) is provided at an end of the third link member 751, and this shaft 751*a* is fitted into an insertion hole (not shown) provided to the base 70, so that the third link member 751 is rotatably linked to the base 70 (more precisely, the first member 70*a*). The fifth linked part 105 cannot be seen because it is hidden by the surface of the base 70 in FIG. 11, so the rotational center of the fifth linked part is shown as the fifth linked part 105.

A sixth linked part 106 is provided at the other end of the third link member 751, and the third link member 751 is rotatably linked to the linking member 753 at the sixth linked part 106.

Fourth Link Member

The fourth link member 752 is a rod-shaped member having two ends, and is disposed parallel to the first link member 732. A seventh linked part 107 is provided at one end of the fourth link member 752, and the fourth link member 752 is rotatably linked to the first link-coupled part 616 at the seventh linked part 107. The seventh linked part 107 cannot be seen because it is hidden by the second link-coupled part 617 in FIG. 11, so the rotational center of the seventh linked part is shown as the seventh linked part 107.

With the seventh linked part 107, the shaft 752*a* provided on the both side in the feed direction X of the end of the fourth link member 752 is inserted into an insertion hole 616*b* formed in a shaft support 616*a* of the first link-coupled part 616 as shown in FIG. 9. With this configuration, the fourth link member 752 is rotatably linked to the first link-coupled part 616.

An eighth linked part 108 is provided at the other end of the fourth link member 752, and the fourth link member 752 is rotatably linked to the linking member 753 at the eighth linked part 108.

Linking Member

The linking member 753 links the third link member 751 and the fourth link member 752 as shown in FIGS. 9 and 10. The linking member 753 has two plates 753*a* disposed so as to sandwich the other end of the third link member 751 and the other end of the fourth link member 752 from both sides in the feed direction X as shown in FIGS. 9 and 10.

At the sixth linked part 106, a pin 106*a* is attached so as to pass through the two plates 753*a* and the end of the third link member 751, and the third link member 751 and the linking member 753 are rotatably linked to each other. Also, at the eighth linked part 108, a pin 108*a* is attached so as to pass through the two plates 753*a* and the end of the fourth link member 752, and the fourth link member 752 and the linking member 753 are rotatably linked to each other.

The linking member 753 is rotatably linked to the first lever member 731 and the first link member 732 at the first linked part 101 described above (see FIG. 11). As shown in FIG. 9, through-holes 753*b* are formed in the two plates 753*a*, and a linking shaft 732*a* is inserted into these through-holes 753*b* so that the linking member 753 is rotatably linked to the first lever member 731 and the first link member 732.

With the above configuration, a parallel link mechanism is formed by the first link mechanism 73 and the third link mechanism 75. That is, as shown in FIG. 11, the line segment L1 connecting the rotational center of the second linked part 102 with the rotational center of the seventh connection portion 107 is parallel to the line segment L2 connecting the rotational center of the eighth linked part 108 and the rotational center of the first linked part 101, and the line segment L3 connecting the rotational center of the first linked part 101 with the rotational center of the sixth linked part 106 is parallel to the line segment L4 connecting the rotational center of the fifth linked part 105 with the rotational center of the output shaft 712*a*. As a result, the supports 6 can always be kept horizontal.

1-4-2-6. Cylinder

The cylinder 76 helps bear the load on the first drive component 71 and the second drive component 72 so as to support the weight of the support 6. The cylinder 76 has a cylinder tube 761 and a piston rod 762, as shown in FIG. 11. The distal end 762*a* of the piston rod 762 is rotatably linked to the second link-coupled part 617 as shown in FIG. 9. The rear end 761*a* of the cylinder tube 761 is rotatably linked to the end face of the plate-like member 83*a* of the adjusting mechanism 8 (discussed below).

1-4-3. Adjustment Mechanism

The adjustment mechanisms 8 are provided to each of the four lifting and clamping drive mechanisms 7 to adjust the position in the clamping direction Y of the lifting clamp drive mechanisms 7 as a whole. The two adjustment mechanisms 8 on the downstream direction X1 side are vertically inverted compared to the two adjusting mechanisms 8 on the upstream direction X2 side, as shown in FIGS. 3 to 5. The adjusting mechanisms 8 on the upstream direction X2 side will be described as an example.

As shown in FIGS. 9 and 10, the adjusting mechanisms 8 each mainly have a base 80, a carrier 81, a pair of rails 82, guide components 83, a screw 84, an electric motor 85, a reduction gear 86 (see FIG. 10), a brake unit 87, and a nut member 88 (see FIG. 9).

The two bases 80 on the upstream direction X2 side are fixed to the floor F as shown in FIG. 4. The rails 82 are disposed parallel to each other along the clamping direction Y on the top face of the base 80 as shown in FIGS. 9 and 10. The carrier 81, which is a rectangular plate-shaped member, is disposed on the rails 82 via the guide components 83.

The guide components 83 are provided at both ends of the carrier 81 on the feed direction X side. The guide components 83 are provided between the carrier 81 and the rails 82, and each have a plate-shaped member 83*a* that is longer in the clamp direction Y, and blocks 83*b* disposed at both ends in the clamp direction Y on the bottom face of the plate-shaped member 83*a*. The blocks 83*b* are substantially cuboid in shape, and a groove is formed along the clamping direction Y on the lower face of each. The rails 82 fit into these grooves.

The nut member 88 is fixed to the lower face of the carrier 81 as shown in FIG. 9. The screw 84 is disposed parallel to the rails 82 in the center of the pair of rails 82, and is inserted through the nut member 88. The inner face of the nut member 88 is threaded and meshes with the screw 84.

The electric motor 85 is disposed in the center of the pair of rails 82, at the inner end of the base 80 in the clamping direction Y, and is connected to the end of the screw 84 via the reduction gear 86 (see FIG. 10). The brake unit 87 is provided to the end of the screw 84 on the opposite side from the electric motor 85.

When the screw 84 is rotated by the drive of the electric motor 85, this rotation causes the carrier 81 to move in the clamping direction Y along with the nut member 88, and the base 70 fixed on the carrier 81 moves in the clamping direction Y. Consequently, the position of the lifting and clamping drive mechanism 7 in the clamp direction Y is adjusted.

This adjustment of the spacing of the pair of lifting and clamping drive mechanisms 7 by adjustment mechanisms 8 is performed to match the die 4 when the die 4 mounted to the press device main body 2 is replaced.

The two adjustment mechanisms 8 on the downstream X1 side are disposed vertically inverted as compared to the two adjusting mechanisms 8 on the upstream direction X2 side, and the bases 80 of the two adjusting mechanisms 8 on the downstream X1 side are fixed to the lower face of the frame 89 that is fixed between the two uprights 22, as shown in FIGS. 2 and 5.

2. Operation

The operation of the transfer press 1 in this embodiment will now be described.

2-1. Position Adjustment

Adjustment of the positions of the lifting and clamping drive mechanisms 7 to match the die 4 mounted to the press device main body 2 is performed during replacement of the die 4, etc.

The lower die 4*b* is disposed on the moving bolster 3, and the upper die 4*a* is attached to the slide 24. Here, the above-mentioned adjustment mechanisms 8 are used to adjust the position of the lifting and clamping drive mechanisms 7 in the clamping direction Y to match the die 4 mounted to the press device main body 2. As discussed above, the electric motor 85 is driven to rotate the screw 84 and move the carrier 81, and to move the lifting and clamping drive mechanisms 7 disposed on the carrier 81 in the clamping direction Y.

This adjusts the spacing between the pair of supports 6 to match the die 4. The adjusted positions of the lifting and clamping drive mechanisms 7 are fixed in the press operation discussed below.

2-2. Press Operation

Figure 12:
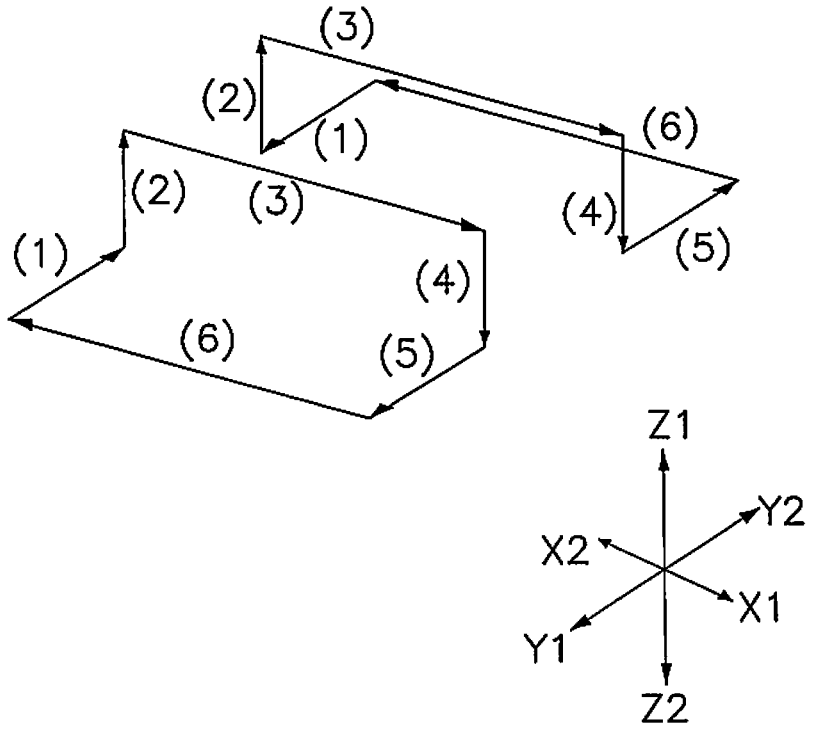
FIG. 12 is a diagram showing the motion of the transfer feeder in FIG. 3.

FIG. 12 is a diagram showing the motion of the transfer feeder 5 in this embodiment.

The workpiece W is transported to a workpiece stand (not shown) on the upstream side of the transfer feeder 5 by a transport device provided on the upstream direction X2 side of the transfer feeder 5. An example of this transport device is a conveyor disposed on the ceiling side used for a destacking feeder.

The supports 6 here are disposed in an unclamped down position. Here, the unclamped position is the outermost position at which the supports 6 are separated from each other. The down position is the position where each of the supports 6 is disposed the farthest in the downward direction Z2.

Figure 13:
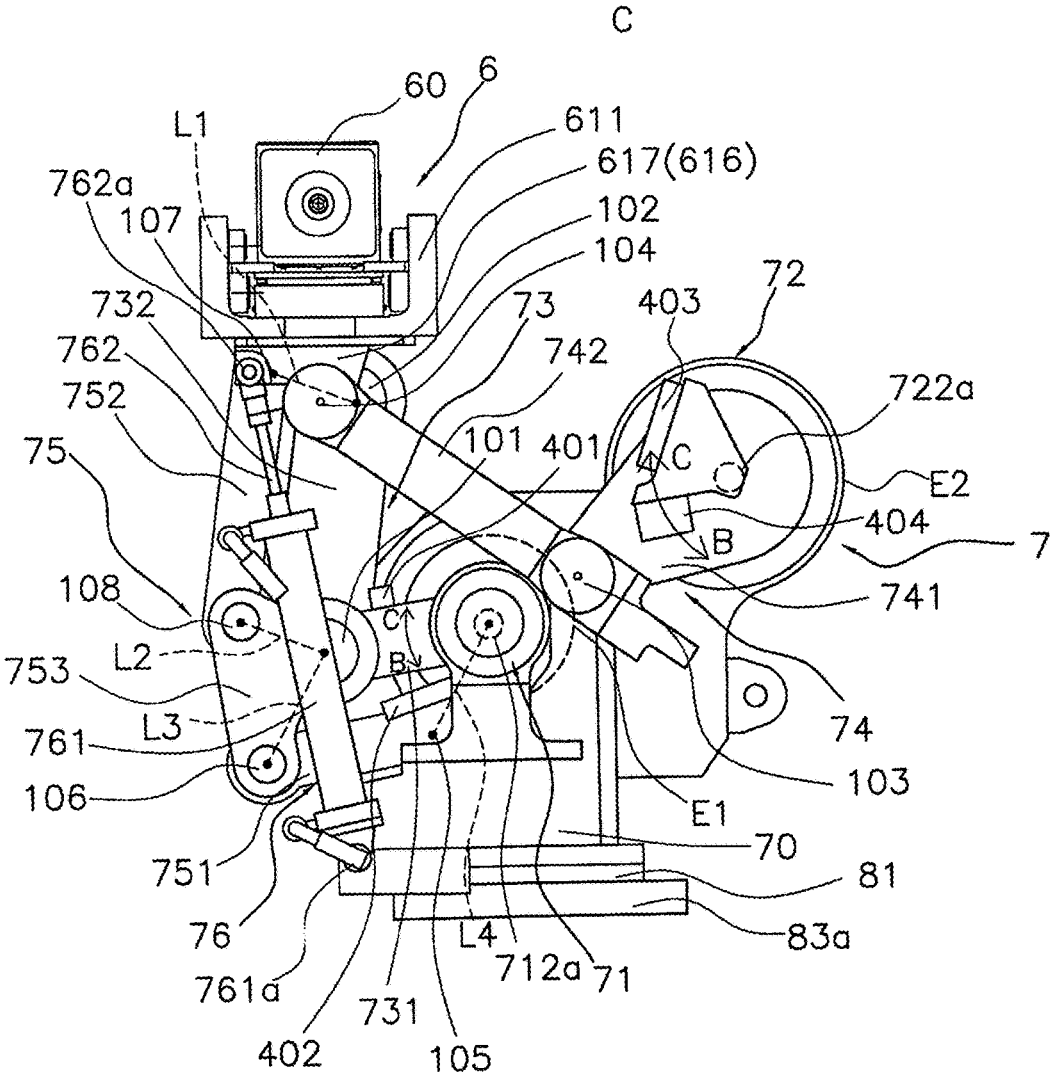
FIG. 13 is a view of the lifting and clamping drive mechanism in FIG. 3, as viewed from the downstream side, in a state in which the supports are disposed in an unclamped down position.
Figure 13:
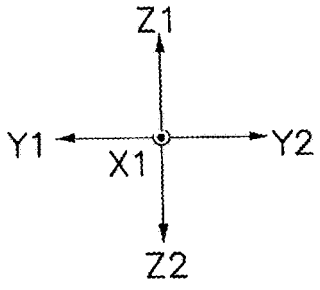

FIG. 13 shows the state when the support 6 is disposed in this unclamped down position. The lifting clamp drive mechanism 7 shown in FIG. 13 is the lifting clamp drive mechanism disposed on the right direction Y1 side and the upstream direction X2 side, and in this diagram is viewed from the downstream direction X1 side. The lifting and clamping drive mechanism 7 on the upstream direction X2 side will now be used as an example to illustrate the operation.

From the state shown in FIG. 13, in order to hold the workpiece W with the fingers 200, the pair of supports 6 is moved by the lifting and clamping drive mechanisms 7 to the inside in the clamping direction Y (see arrow 1 in FIG. 12). Consequently, the supports 6 are disposed in the clamped down position. The clamped down position is a position in which the supports 6 are close together, and is the position where the workpiece W is held by the fingers 200. The above-mentioned FIG. 11 shows a state in which the support 6 is disposed in the clamped down position.

As described above, when the supports 6 move from the unclamped down position to the clamped down position, the workpiece W is held by the fingers 200. The clamped position is a position where the supports 6 are close together, and is the innermost position.

More precisely, from the state shown in FIG. 13, when the first electric motor 711 rotates clockwise in FIG. 13 (see the arrow C) and the second electric motor 721 rotates counterclockwise in FIG. 13 (see the arrow B), the first lever member 731 rotates clockwise and the second lever member 741 counterclockwise, and the supports 6 move inward in the clamping direction Y in a state of being positioned below. Here, because a parallel link is constituted by the first link mechanism 73 and the third link mechanism 75, the supports 6 can move in the clamping direction Y while remaining horizontal.

Next, the lifting and clamping drive mechanisms 7 move the supports 6 in the upward direction Z1 in a state in which the position in the clamp direction Y is maintained (see the arrow 2 in FIG. 12). Consequently, the supports 6 are disposed in the clamped up position shown in FIG. 14. The up position is the position at which the supports 6 have moved the highest upward.

More precisely, when the first electric motor 711 and the second electric motor 721 rotate clockwise (see the arrow C) from the state shown in FIG. 11, this causes the first lever member 731 and the second lever member 741 also to rotate clockwise, and the supports 6 move in the upward direction Z1.

The result of this operation is that the workpiece W is lifted up in the upward direction Z1 by the fingers 200 provided to the supports 6.

Next, the feed drive mechanism 61 moves the bars 60 in the downstream direction X1 (see the arrow 3 in FIG. 12). More specifically, current is supplied to the coil 615, which generates attractive or repulsive force between the coil 615 and the magnet 614, and the bars 60 move in the downstream direction X1. Consequently, the workpiece W held by the fingers 200 moves into the die 4 on the downstream direction X1 side of the workpiece table.

Next, the lifting and clamping drive mechanisms 7 move the supports 6 in the downward direction Z2 in a state in which the position in the clamping direction Y maintained (see the arrow 4 in FIG. 12), resulting in the state shown in FIG. 11, and the supports 6 are disposed in the clamped down position.

Figure 14:
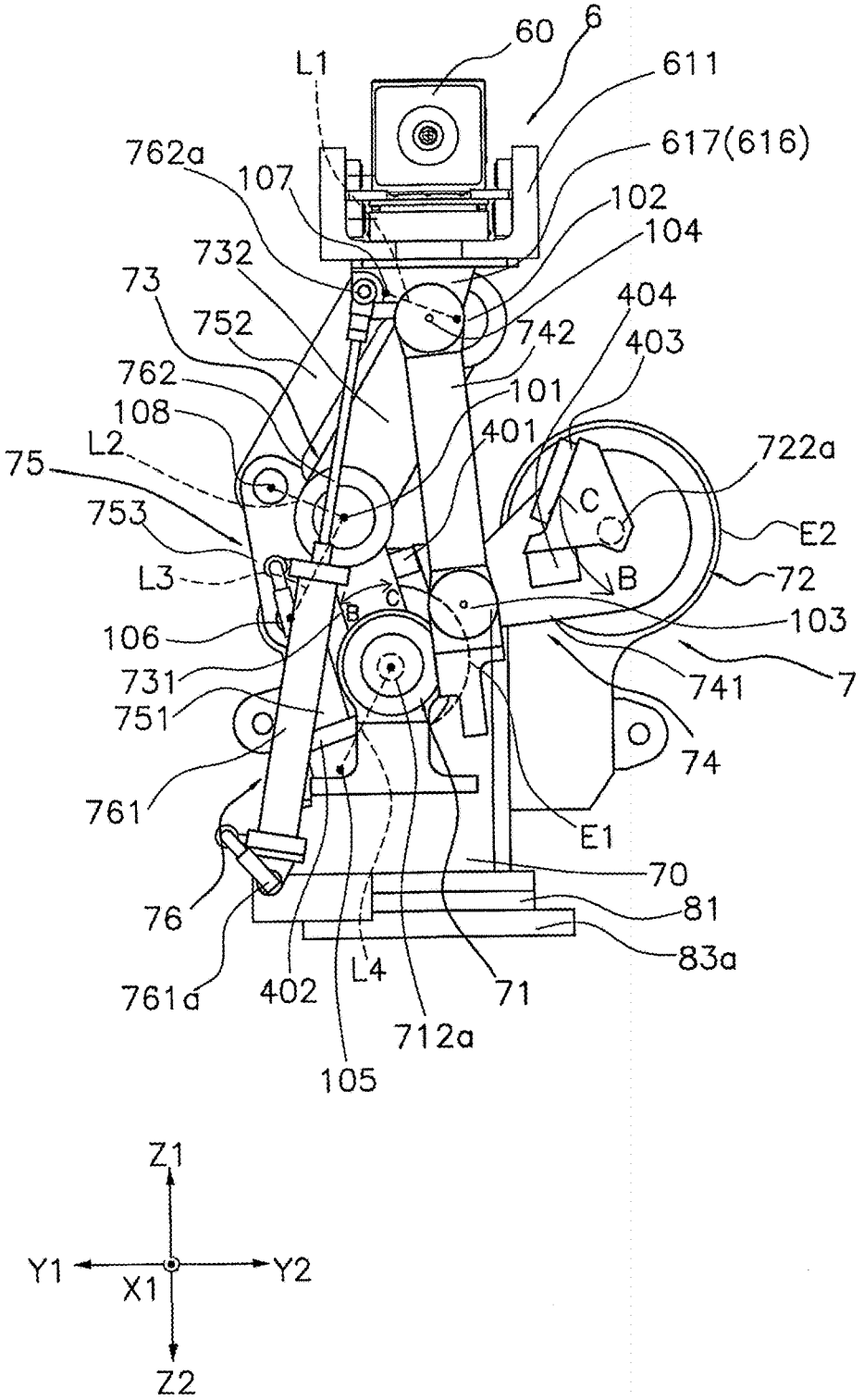
FIG. 14 is a view of the lifting and clamping drive mechanism in FIG. 3, as viewed from the downstream side, in a state in which the supports are disposed in a clamped up position.

More precisely, when the first electric motor 711 and the second electric motor 721 rotate counterclockwise (see the arrow B) from the state shown in FIG. 14, this causes the first lever member 731 and the second lever member 741 also to rotate counterclockwise, and the supports 6 move in the downward direction Z2.

Consequently, the workpiece W held by the fingers 200 is placed on the lower die 4*b*.

Then, the lifting and clamping drive mechanisms 7 move the supports 6 horizontally to the outside in the clamping direction Y (see the arrow 5 in FIG. 12), resulting in the state shown in FIG. 13, and the supports 6 are disposed in the unclamped down position. More precisely, from the state in FIG. 11, the first electric motor 711 rotates counterclockwise in FIG. 11 (see the arrow B), and the second electric motor 721 rotates clockwise (see the arrow C) in FIG. 11, which causes the first lever member 731 to rotate counterclockwise, the second lever member 741 to rotate clockwise, and the supports 6 to move outward in the clamping direction Y.

Consequently, the supports 6 separate from the die 4 and the workpiece W is released by the fingers 200.

Then, the feed drive mechanism 61 moves the bars 60 to the upstream direction X2 side of the feed direction X (see the arrow 6 in FIG. 12).

Thus, by repeating the above series of operations, the workpiece W is transported to the downstream direction X1 side of the feed direction X and is successively subjected to pressing by the dies 4, which are disposed along the feed direction X. This pressing is performed by lowering the slide 24 between the arrows 5, 6, and 1 in FIG. 12.

Next, the operation of the lifting and clamping drive mechanism 7 on the downstream direction X1 side will be described in comparison with the lifting clamp drive mechanism 7 on the upstream direction X2 side.

Figure 15A:
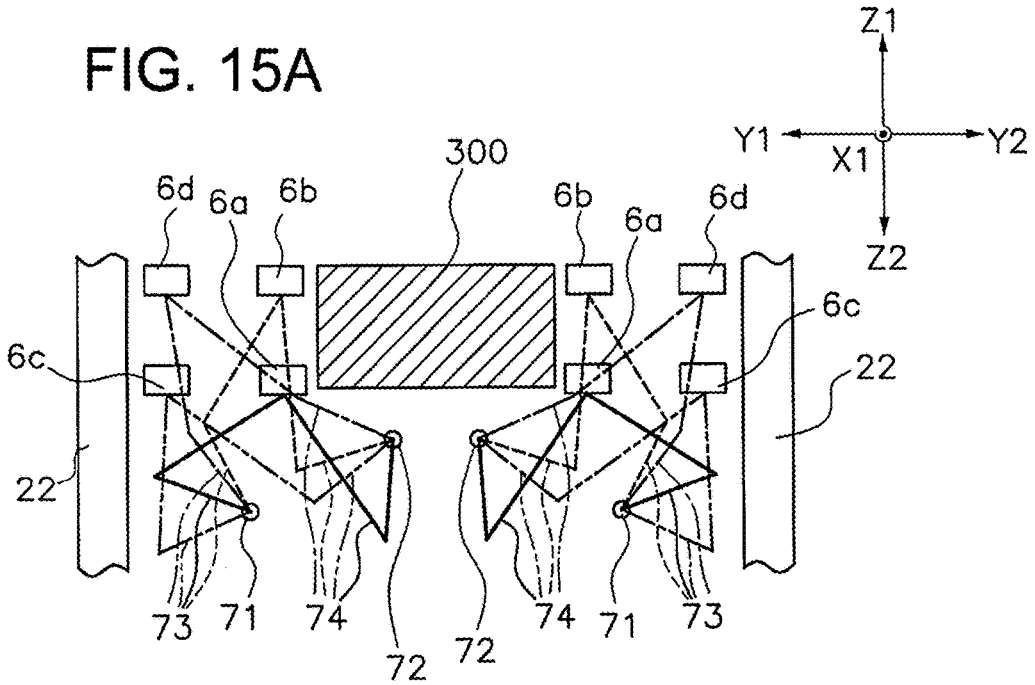
FIG. 15A is a simplified diagram showing the motion of the lifting and clamping drive mechanism on the upstream side in FIG. 3.

First, we will describe FIG. 15A, which is a simplified depiction of the motion of the lifting and clamping drive mechanism 7 on the upstream direction X2 side.

In FIG. 15A, the supports 6 in a state of being disposed in the clamped down position are shown as the supports 6*a*, and the first link mechanism 73 and the second link mechanism 74 in the clamped down position are indicated by solid lines. The supports 6 in a state of being disposed in the clamped up position are shown as the supports 6*b*, and the first link mechanism 73 and the second link mechanism 74 in the clamped up position are indicated by dotted lines. The supports 6 in a state of being disposed in the unclamped down position are shown as the supports 6*c*, and the first link mechanism 73 and the second link mechanism 74 in the unclamped down position are indicated by two-dot chain lines.

Figure 16:
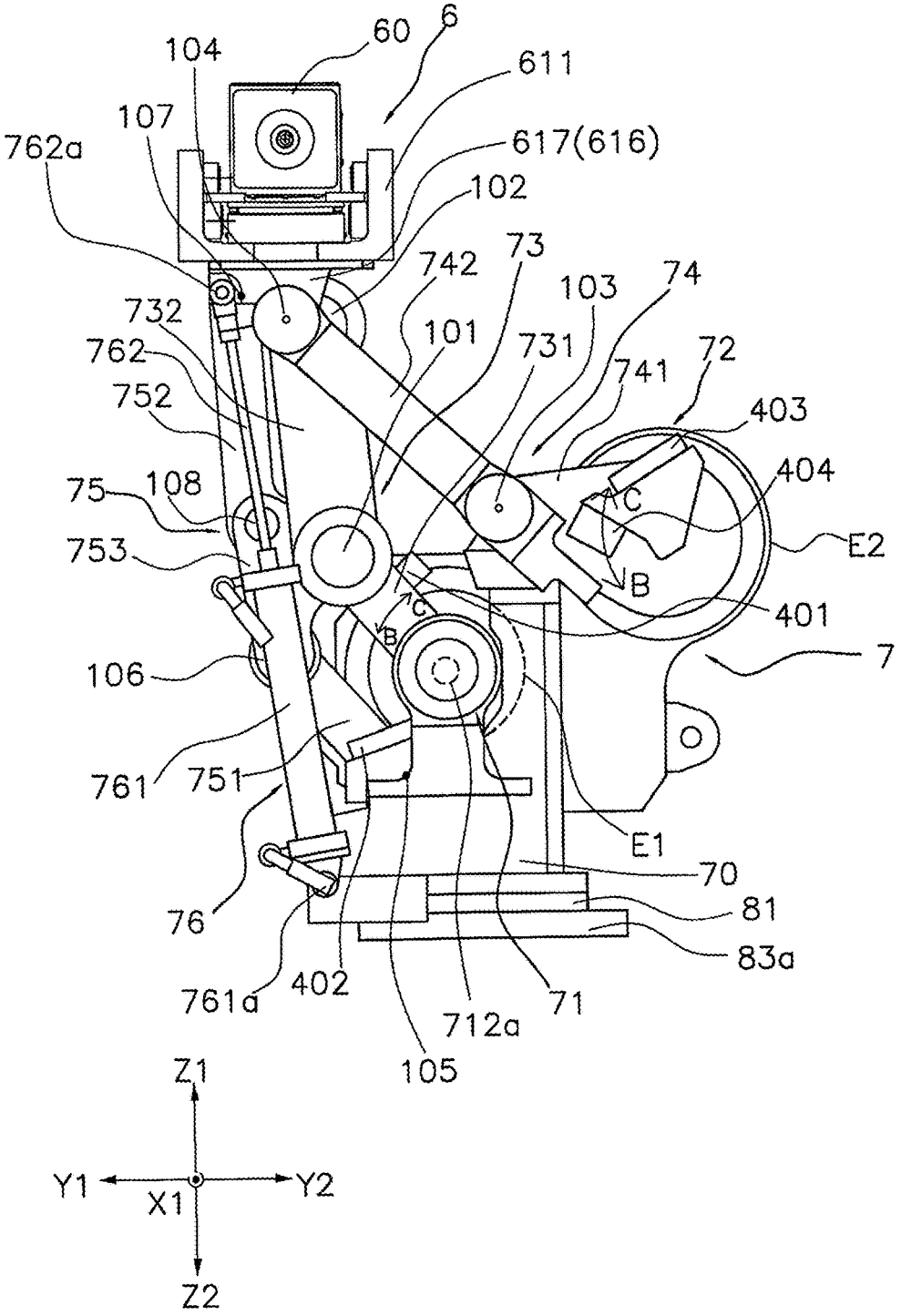
FIG. 16 is a view of the lifting and clamping drive mechanism in FIG. 3, as viewed from the downstream side, in a state in which the supports are disposed in an unclamped up position.

Although the supports 6 do not move during the motion of transporting the workpiece W, the supports 6 in a state of being disposed in the unclamped up position are shown as the supports 6*d*. The first link mechanism 73 and the second link mechanism 74 in the unclamped up position are indicated by one-dot chain lines. The transport device is disposed in the space 300 between the pair of supports 6. FIG. 16 is a diagram showing the state of the lifting and clamping drive mechanism 7 in the unclamped up position.

In the replacement of the die 4, the moving bolster 3 moves to the outside of the press device main body 2 by moving in the clamping direction Y between the uprights 22, but the center portion of the bars 60 at this point is separated from the portion supported by the support frame 611 on the upstream direction X2 side and the portion supported by the support frame 611 on the downstream direction X1 side, and moves to the outside of the press device main body 2 along with the moving bolster 3. In this movement of the moving bolster 3 and the center portion of the bars 60 to the outside of the press device main body 2, the supports 6 are in the state of the supports 6*c* (unclamped down position) or the supports 6*d* (unclamped up position).

Figure 15B:
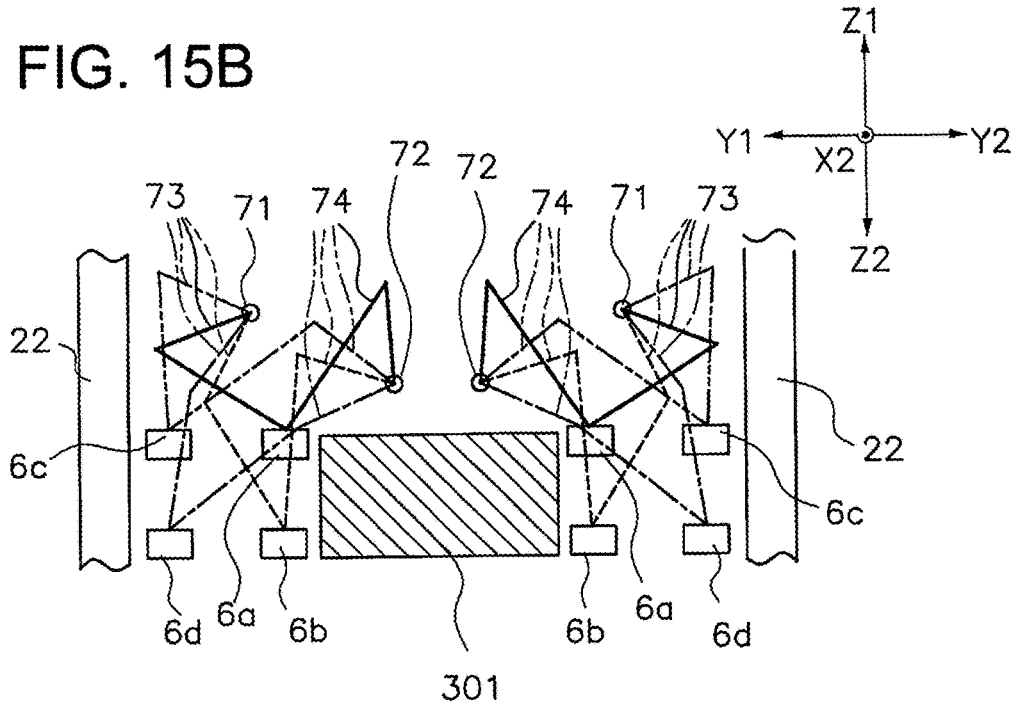
FIG. 15B is a simplified diagram showing the motion of the lifting and clamping drive mechanism on the downstream side in FIG. 3.

Meanwhile, FIG. 15B is a simplified diagram showing the motion of the supports 6 and the lifting and clamping drive mechanism 7 on the downstream X1 side in this embodiment. On the downstream direction X1 side, the supports 6 are disposed so as to be suspended by the first link mechanism 73 and the second link mechanism 74.

The supports 6*a*, 6*b*, 6*c*, and 6*d* in the states shown in FIG. 15B on the downstream direction X2 side show the supports 6 in the positions where the state of the first link mechanism 73 and the second link mechanism 74 is the same as that of the supports 6*a*, 6*b*, 6*c*, and 6*d* in the respective positions on the upstream direction X2 side. In other words, the supports 6*a*, 6*b*, 6*c*, and 6*d* on the downstream direction X2 side are numbered to be in vertical symmetry with the supports 6*a*, 6*b*, 6*c*, and 6*d* on the upstream direction X2 side.

The supports 6*b* show the state of being disposed in the clamped down position, the supports 6*a* show the state of being disposed in the clamped up position, and the supports 6*d* show the state of being disposed in the unclamped down position.

That is, the arrows (1) shown in FIG. 12 indicate the movement of the supports 6 from the state of the supports 6*d* to the state of the supports 6*b*, and the arrows (2) shown in FIG. 12 indicate the movement from the state of the supports 6*b* to the state of the supports 6*a*. The arrows (4) indicate the movement of the supports 6 from the state of the supports 6*a* to the state of the supports 6*b*, and the arrows (5) indicate the movement from the state of the supports 6*b* to the state of the supports 6*d*.

The first link mechanism 73 and the second link mechanism 74 at the supports 6*b* on the downstream direction X1 side (clamped down position) are in the state shown in FIG. 14. The first link mechanism 73 and the second link mechanism 74 at the supports 6*a* on the downstream direction X1 side (clamped up position) are in the state shown in FIG. 11. The first link mechanism 73 and the second link mechanism 74 at the supports 6*d* on the downstream direction X1 side (unclamped down position) are in the state shown in FIG. 16.

The first link mechanism 73 and the second link mechanism 74 at the supports 6*c* on the downstream direction X1 side (unclamped up position) are in the state shown in FIG. 13. In the state of the supports 6*c* on the downstream X1 side (unclamped up position) or the supports 6*d* (unclamped down position), the moving bolster 3 and the center portion of the bars 60 are moved to the outside of the press device main body 2, and replacement of the die 4 is carried out.

3. Key Features (3-1)

The transfer feeder 5 (an example of a workpiece transport device) in this embodiment is a workpiece transport device used in the transfer press 1 (an example of a press machine), and comprises the pair of supports 6 and the lifting and clamping drive mechanisms 7 (an example of a drive mechanism). The pair of supports 6 movably support the fingers 200 (an example of a holder), which hold the workpiece W, in the transport direction X of the workpiece W. The lifting and clamping drive mechanisms 7 are provided to the supports 6 and the lifting and clamping drive mechanism 7 moves the support 6 in the lifting direction Z (an example of the up and down direction) and in the clamping direction Y (an example of the width direction). Each lifting and clamping drive mechanism 7 has a first drive component 71, a second drive component 72, a first link mechanism 73, and a second link mechanism 74. The first drive components 71 and the second drive components 72 respectively have the first electric motor 711 and the second electric motor 721 (an example of an electric motor) as a drive source for moving the support 6 in the lifting direction Z and the clamping direction Y (an example of the width direction). The first link mechanism 73 connects the support 6 and the first drive component 71. The second link mechanism 74 connects the support 6 and the second drive component 72.

Since link mechanisms are thus used to move the supports 6 in the clamping direction Y and the lifting direction Z, parts will not need to be replaced as often as when a mechanism featuring a ball screw.

With a conventional linear motion mechanism that makes use of a ball screw and nut or the like, wear of these components becomes a problem, and it is difficult to increase speed. With this embodiment, however, the linear motion mechanism is replaced by a clamping and lifting mechanism, so the link mechanisms are rotated by the rotational power of motors, which improves durability and allows the workpiece transfer device to operate faster.

(3-2)

With the transfer feeder 5 in this embodiment, the first link mechanism 73 is connected directly to the support 6, and the second link mechanism 74 is also connected directly to the support 6. This allows the drive produced by the first drive component 71 to be transmitted directly to the support 6 through the first link mechanism 73. Also, the drive produced by the second drive component 72 can be transmitted directly to the support 6 through the second link mechanism 74.

(3-3)

With the transfer feeder 5 in this embodiment, the first link mechanisms 73 each have a first link member 732 and a first lever member 731. The first link member 732 is rotatably linked to the support 6. The first lever member 731 is connected to the first drive component 71, and is rotated by the first drive component 71. The first link member 732 and the first lever member 731 are rotatably linked to each other. The second link mechanisms 74 each have a second link member 742 and a second lever member 741. The second link member 742 is rotatably linked to the support 6. The second lever member 741 is connected to the second drive component 72, and is rotated by the second drive component 72. The second link member 742 and the second lever member 741 are rotatably linked to each other.

Thus, the first lever member 731 and the first link member 732 can transmit the rotation of the first electric motor 711 to the support 6. Also, the second lever member 741 and the second link member 742 can transmit the rotation of the second electric motor 721 to the support 6.

(3-4)

With the transfer feeder 5 in this embodiment, the lifting and clamping drive mechanisms 7 further have a base 70. The first drive component 71 and the second drive component 72 are fixed to the base 70.

Thus fixing the first drive component 71 and the second drive component 72 to the base 70 prevents deterioration of wiring and the like, because the wiring or the like to the first electric motor 711 and the second electric motor 721 does not move during the transport of the workpiece W.

(3-5)

With the transfer feeder 5 in this embodiment, the lifting and clamping drive mechanisms 7 each further have a base 70 and a third link mechanism 75. The first drive component 71 and the second drive component 72 are fixed to the base 70. The third link mechanism 75 form a parallel link with the first link mechanism 73, and connects the support 6 and the base 70.

Thus forming a parallel link allows the support 6 to be moved in the up and down direction and the width direction in a state in which the support is stably kept horizontal.

As shown in FIGS. 9 and 10, the first link mechanism 73 is formed thicker in the feed direction X than the second link mechanism 74. Therefore, the first link mechanism 73 has higher rigidity than the second link mechanism 74. When a parallel link is formed and operated, the reaction force thereof will be received, so the third link mechanism 75 preferably forms a parallel link with the more rigid first link mechanism 73.

(3-6)

With the transfer feeder 5 in this embodiment, the third link mechanisms 75 each have a third link member 751, a fourth link member 752, and a linking member 753. The third link member 751 is rotatably linked to the base 70 and is disposed parallel to the first lever member 731. The fourth link member 752 is rotatably linked to the support 6 and is disposed parallel to the first link member 732. The linking member 753 is rotatably linked to the third link member 751, and is rotatably linked to the fourth link member 752. The linking member 753 is rotatably linked to the first link member 732 and the first lever member 731 at the first linked part 101 (an example of a linked part) of the first link member 732 and the first lever member 731.

Thus, a parallel link can be formed by the third link mechanism 75 and the first link mechanism 73.

(3-7)

With the transfer feeder 5 in this embodiment, the first link mechanism 73 is disposed at the same position as the inner end E1 of the first drive component 71, or farther to the outside than this end E1, in the clamping direction Y (an example of the width direction), as shown in FIGS. 11, 13, and 14. The second link mechanism is disposed at the same position as the inner end E2 of the second drive component 72, or farther to the outside than this end E2, in the clamping direction (an example of the width direction).

Thus, the first link mechanism 73 is configured so as not to protrude farther inward than the first drive component 71, and the second link mechanism 74 is configured so as not to protrude farther inward than the second drive component 72.

Therefore, the link mechanisms will not protrude into the space between the pair of supports 6 (see the space 300 in FIG. 4, and the space 301 in FIG. 5). Accordingly, a large space for movement of the workpiece W can be ensured.

Also, hand-over of the workpiece W will be easier in the loading of the workpiece W from the loading device to the transfer press 1 (an example of a press device), and in the unloading of the workpiece W from the transfer press 1 to the unloading device (see the belt conveyor 500 in FIG. 5). Furthermore, when the loading device and the unloading device are disposed such that they go into the transfer press 1, it will be easier to dispose the loading device and the unloading device between the pair of supports.

Figure 17A:
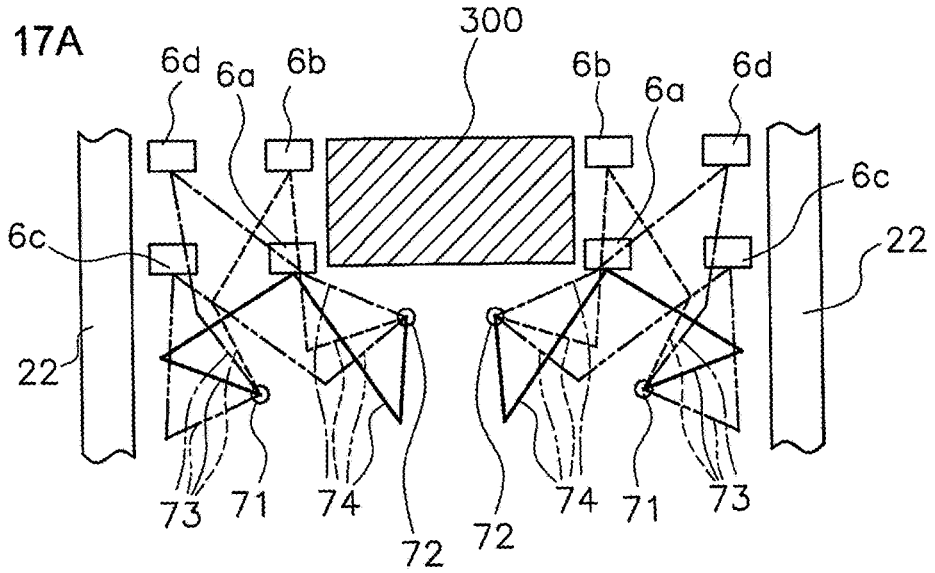
FIG. 17A is a simplified diagram showing the motion of the lifting and clamping drive mechanism on the upstream side in FIG. 3.
Figure 17B:
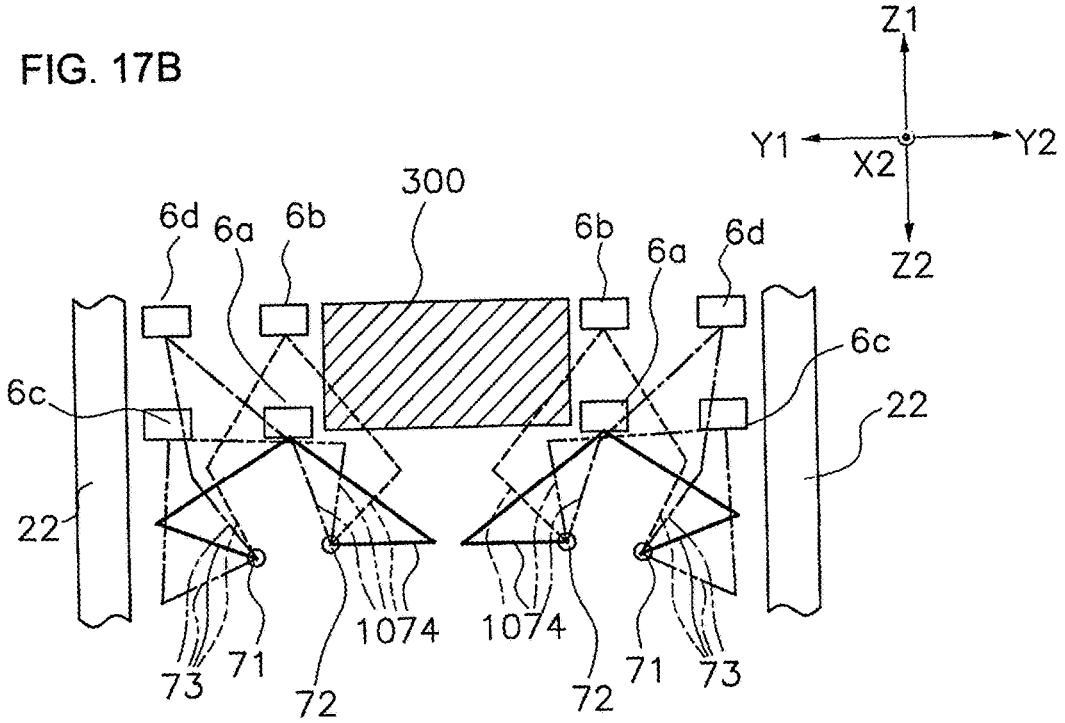
FIG. 17B is a simplified diagram showing the motion of a lifting and clamping drive mechanism configured so that the second link mechanism protrudes further inward than the second drive component.

This will be described in detail through reference to FIGS. 17A and 17B. FIG. 17A is the same as FIG. 15A. On the other hand, FIG. 17B is a diagram showing a configuration in which the supports 6 and the second drive components 72 are linked by second link mechanisms 1074 that protrude farther to the inside in the clamping direction Y than the second drive components 72. A comparison of FIGS. 17A and 17B reveals that when the supports 6 are disposed in the clamped up position (see the supports 6*b*), the second link mechanisms 1074 overlap the space 300. Since the second link mechanisms 1074 stick out in this way, there is less space in which to dispose the transport device for transporting the workpiece to the transfer press 1.

That is, by configuring the first link mechanism 73 and the second link mechanism 74 so as not to protrude inward as in this embodiment, it is possible to ensure a wide space between the supports 6, it is easier to move the workpiece W, and it is easier to load the work W from the loading device into transfer press 1. The same applies when discharging the workpiece W from the transfer press 1, that is, the wide space 301 shown in FIG. 5 can be ensured, and it is easier to unload the workpiece W to discharge device such as a belt conveyor.

(3-8)

The transfer feeder 5 in this embodiment further comprises the adjusting mechanisms 8. The adjusting mechanisms 8 adjust the spacing of the pair of supports 6 by moving the bases 70 in the clamping direction Y (an example of the width direction). In transporting the workpiece W, the support 6 moves in the lifting direction Z and the clamping direction Y in a state in which the base 70 is fixed at the position adjusted by the adjustment mechanisms 8.

Thus, the adjusting mechanisms 8 for adjusting the spacing between the pair of supports 6 in the clamping direction Y, are provided separately from the lifting and clamping drive mechanisms 7 for moving the support 6 in the lifting direction Z and the clamping direction Y when the workpiece W is transported in a pressing operation.

With a conventional transfer feeder, the above-mentioned adjustment and movement are carried out by a single mechanism, but separating this into two mechanisms as in the present invention allows the distance by which the support 6 is moved by each mechanism to be shortened. Therefore, fewer parts are required in each mechanism, and the amount of energy needed for drive can be reduced. Moreover, because there are fewer parts, the product is lighter and the speed can be increased.

In this embodiment, a linear motion mechanism featuring the screw 84 is used for the adjustment mechanisms 8, but the number of times the adjusting mechanisms 8 are driven is far lower than the number of times the lifting and clamping drive mechanisms 7 are driven, namely, about 1/800 as many times, so this configuration does not affect how often parts need to be replaced.

Other Embodiments

An embodiment of the present invention was described above, but the present invention is not limited to that embodiment, and various modifications are possible without departing from the gist of the invention.

(A)

In the above embodiment, the lifting and clamping drive mechanisms 7 and the adjustment mechanisms 8 on the downstream direction X1 side were vertically inverted as compared to the lifting and clamping drive mechanisms 7 and the adjustment mechanisms 8 on the upstream direction X2 side, but this is not the only option, and the up and down direction of the lifting and clamping drive mechanisms 7 and the adjustment mechanisms 8 may be the same on the upstream direction X2 side and the downstream direction X1 side.

(B)

In the above embodiment, the third link mechanisms 75 form parallel links with the first link mechanisms 73, but may instead form parallel links with the second link mechanisms 74.

(C)

In the above embodiment, the bars 60 move in the feed direction X, but the configuration may instead be such that the bars 60 themselves do not move, slide plates disposed on the upper side thereof, and the slide plates move in the feed direction X. In that case, a feed drive mechanism with a linear motor is provided between the slide plate and the bar.

(D)

In the above embodiment, the first link mechanisms 73 are linked to the first link-coupled parts 616, and the second link mechanisms 74 are linked to the second link-coupled parts 617, so that the first link mechanisms 73 and the second link mechanisms 74 are directly connected to the supports 6, but the first link mechanisms 73 and the second link mechanisms 74 may instead be indirectly connected via some other member.

(E)

In the above embodiment, the feed drive mechanisms 61 are provided at two places, on the upstream side and the downstream side, for a single bar 60, but a feed drive mechanism 61 may be provided only on one side, and the other side merely supported so that the bar 60 can move in the feeder direction X.

However, providing the feed drive mechanisms 61 at two places as in the above embodiment is preferable as it reduces the load that is exerted on one side. If the feed drive mechanism 61, the lifting and clamping drive mechanism 7, and the adjustment mechanism 8 on the upstream direction X2 side and the left direction Y2 side serve as a single first unit, and the feed drive mechanism 61, the lifting and clamping drive mechanism 7, and the adjustment mechanism 8 on the upstream direction X2 side and the right direction Y1 side serve as a single second unit, then when the feed drive mechanisms 61 are provided both upstream and downstream, the first unit and the second unit can also be used for the downstream direction X2 side merely by being turned upside down. This is preferable because the use of the same unit means that there is no need to increase the number of parts.

(F)

In the above embodiment, a screw mechanism having the screw 84 was used for the adjusting mechanism 8, but a ball screw mechanism may be used instead of a screw mechanism.

(G)

In the above embodiment, an example was given in which the workpiece W was simply supported by the fingers 200, as an example of a holder, but the holder may instead be a gripper that is used to grip the workpiece W.

INDUSTRIAL APPLICABILITY

The workpiece transport device of the present invention has the effect of affording a longer replacement period for the parts, and is useful as a workpiece transport device used in a transfer press or the like.

The invention claimed is:

1. A workpiece transport device used in a press machine, the workpiece transport device comprising:

a pair of supports supporting a holder useable to hold a workpiece, so as to allow movement in a transport direction of a workpiece; and drive mechanisms provided to the pair of supports, the drive mechanisms being configured to move the supports in an up and down direction and a width direction, each drive mechanism including a first drive component and a second drive component with each including an electric motor as a drive source, a first link mechanism connecting the first drive component and the support, and a second link mechanism connecting the second drive component and the supports, the first link mechanism including a first link member rotatably linked to the supports, and a first lever member connected to the first drive component, the first lever member configured to be rotated by the first drive component, the first link member and the first lever member being rotatably linked to each other by a linking shaft, and the second link mechanism including a second link member rotatably linked to the supports, and a second lever member connected to the second drive component, the second lever member configured to be rotated by the second drive component, the second link member and the second lever member being rotatably linked to each other.

2. The workpiece transport device according to claim 1, wherein the first link mechanism is connected directly to the pair of supports, and the second link mechanism is connected directly to the support.

3. The workpiece transport device according to claim 1, wherein each drive mechanism further includes a base to which the first drive component and the second drive component are fixed.

4. The workpiece transport device according to claim 3, further comprising at least one adjustment mechanism configured to adjust a spacing of the pair of supports by moving at least one of the bases in the width direction, when the workpiece is transported, the support moves in the up and down direction and the width direction in a state in which the base is fixed in a position adjusted by the adjustment mechanism.

5. The workpiece transport device according to claim 1, wherein each drive mechanism further includes a base to which the first drive component and the second drive component are fixed, and a third link mechanism forming a parallel link with the first link mechanism, the third link mechanism connecting the support and the base.

6. The workpiece transport device according to claim 5, wherein the third link mechanism includes a third link member disposed parallel to the first lever member, the third link member rotatably linked to the base, a fourth link member disposed parallel to the first link member, the fourth link member rotatably linked to the support, and a linking member rotatably linked to the third link member and the fourth link member, the linking member rotatably linked to the first link member and the first lever member at the linking shaft.

7. The workpiece transport device according to claim 1, wherein the first lever member rotates around an axis extending in the transport direction, and the second lever member rotates around an axis extending in the transport direction.

8. A workpiece transport device used in a press machine, the workpiece transport device comprising:

a pair of supports supporting a holder useable to hold a workpiece, so as to allow movement in a transport direction of a workpiece; and drive mechanisms provided to the pair of supports, the drive mechanisms being configured to move the supports in an up and down direction and a width direction, each drive mechanism including a first drive component and a second drive component with each including an electric motor as a drive source, a first link mechanism connecting the first drive component and the support, and a second link mechanism connecting the second drive component and the support, the first link mechanism being disposed more to an outside in the width direction than an inner end of the first drive component, or at a same position in the width direction as the inner end of the first drive component, and the second link mechanism being disposed more to an outside in the width direction than an inner end of the second drive component, or at a same position in the width direction as the inner end of the second drive component.

* * * * *